US008091654B2

(12) United States Patent
Tedeschi et al.

(10) Patent No.: US 8,091,654 B2
(45) Date of Patent: Jan. 10, 2012

(54) ROCK BIT WITH VECTORED HYDRAULIC NOZZLE RETENTION SLEEVES

(75) Inventors: Luca Tedeschi, Volterra (IT); James L. Larsen, Spring, TX (US); Gary Portwood, Florence (IT); Riccardo Gronchi, Certaldo (IT)

(73) Assignee: Smith International, Inc, Houston, TX (US)

( * ) Notice: Subject to any disclaimer, the term of this patent is extended or adjusted under 35 U.S.C. 154(b) by 246 days.

(21) Appl. No.: 12/104,856

(22) Filed: Apr. 17, 2008

(65) Prior Publication Data

US 2009/0159340 A1 Jun. 25, 2009

Related U.S. Application Data

(60) Provisional application No. 60/979,806, filed on Oct. 12, 2007, provisional application No. 61/038,888, filed on Mar. 24, 2008.

(51) Int. Cl.
*E21B 10/61* (2006.01)
*E21B 10/18* (2006.01)

(52) U.S. Cl. ..... 175/393; 175/340; 175/424; 175/429

(58) Field of Classification Search ..... 175/340, 175/393, 341, 424, 429
See application file for complete search history.

(56) References Cited

U.S. PATENT DOCUMENTS 2,901,223 A 8/1959 Scott
4,187,921 A * 2/1980 Garner ..... 175/340
4,369,849 A * 1/1983 Parrish ..... 175/340
4,611,673 A 9/1986 Childers et al.
4,665,999 A * 5/1987 Shoemaker ..... 175/340
4,741,406 A 5/1988 Deane et al.
4,776,412 A * 10/1988 Thompson ..... 175/393
4,848,476 A 7/1989 Deane et al.
4,984,643 A * 1/1991 Isbell et al. ..... 175/341
5,538,093 A 7/1996 Siracki et al.
5,601,153 A * 2/1997 Ensminger et al. ..... 175/340
(Continued)

FOREIGN PATENT DOCUMENTS

CA 1 182 105 2/1985
(Continued)

OTHER PUBLICATIONS

Combined Search and Examination Report dated Feb. 23, 2009 for Appl. No. GB 0818100.0, 7pp.

(Continued)

*Primary Examiner* — Jennifer H Gay
(74) *Attorney, Agent, or Firm* — Christie, Parker & Hale, LLP

(57) ABSTRACT

A drill bit for drilling through an earthen formation to form a borehole includes a bit body having a central axis, an internal plenum, and an underside. The underside includes an annular outer region. The bit body includes an outer receptacle extending from the plenum to the outer region. In addition, the drill bit comprises a first and a second cone cutter. Each cone cutter comprises an outer region distal the bit axis. Further the drill bit comprises an outer sleeve having an upstream end received by the outer sleeve receptacle and a through passage. The through passage includes an upstream section having an upstream axis and a downstream section having a downstream axis that is skewed at an angle α relative to the upstream axis. A projection of the downstream axis passes between the outer regions of the first and second cone cutters.

67 Claims, 12 Drawing Sheets

U.S. PATENT DOCUMENTS

| | | | | |
|---|---|---|---|---|
| 5,853,055 | A | 12/1998 | Siracki et al. | |
| 6,065,683 | A * | 5/2000 | Akin et al. | 239/5 |
| 6,098,728 | A | 8/2000 | Wells et al. | |
| 6,290,006 | B1 | 9/2001 | Crawford | |
| 6,311,793 | B1 * | 11/2001 | Larsen et al. | 175/340 |
| 6,354,387 | B1 | 3/2002 | Harris et al. | |
| 6,390,211 | B1 * | 5/2002 | Tibbitts | 175/340 |
| 6,571,887 | B1 | 6/2003 | Nguyen et al. | |
| 6,585,063 | B2 * | 7/2003 | Larsen | 175/57 |
| 6,651,758 | B2 * | 11/2003 | Xiang et al. | 175/431 |
| 7,188,682 | B2 * | 3/2007 | Larsen et al. | 175/57 |
| 7,213,661 | B2 * | 5/2007 | Larsen et al. | 175/340 |
| 7,370,711 | B2 * | 5/2008 | Singh | 175/77 |
| 2004/0238225 | A1 * | 12/2004 | Larsen et al. | 175/340 |
| 2005/0121235 | A1 * | 6/2005 | Larsen et al. | 175/340 |
| 2006/0054355 | A1 * | 3/2006 | Larsen et al. | 175/40 |
| 2006/0266557 | A1 * | 11/2006 | Estes | 175/340 |
| 2007/0034411 | A1 * | 2/2007 | Singh | 175/77 |
| 2007/0163811 | A1 * | 7/2007 | Gutmark et al. | 175/340 |
| 2009/0095536 | A1 * | 4/2009 | Tedeschi et al. | 175/340 |
| 2009/0152013 | A1 * | 6/2009 | Buske et al. | 175/340 |
| 2009/0159340 | A1 * | 6/2009 | Tedeschi et al. | 175/340 |
| 2009/0188724 | A1 * | 7/2009 | Portwood et al. | 175/341 |

FOREIGN PATENT DOCUMENTS

| | | | |
|---|---|---|---|
| GB | 872076 | | 7/1961 |
| GB | 2408763 | A * | 6/2005 |
| GB | 2443115 | A | 4/2008 |
| GB | 2454068 | B | 6/2010 |
| GB | 2461429 | B | 6/2010 |
| GB | 2461430 | B | 6/2010 |
| RU | 2 019 668 | C1 | 9/1994 |
| RU | 2 191 244 | C1 | 10/2002 |

OTHER PUBLICATIONS

Combined Search and Examination Report for Appl No. GB 0818100.0 dated Dec. 21, 2009, 1pg.
Response to Combined Search and Examination Report dated Dec. 21, 2009 for Appl. No. GB 0818100.0, 24 pp.
Response to Combined Search and Examination Report dated Oct. 29, 2009 for Appl No. GB 0916876.6, 29pp.
Response to Combined Search and Examination Report dated Oct. 29, 2009 for Appl. No. GB 0916877.4, 21 pp.
Combined Search and Examination Report dated Oct. 29, 2009 for Appl. No. GB 0916876.6, 6pp.
Combined Search and Examination Report dated Oct. 29, 2009 for Appl. No. GB 0916877.4, 8pp.

* cited by examiner

ROCK BIT WITH VECTORED HYDRAULIC NOZZLE RETENTION SLEEVES

CROSS-REFERENCE TO RELATED APPLICATIONS

This application claims benefit of U.S. provisional application Ser. No. 60/979,806 filed Oct. 12, 2007, and entitled "Rock Bit with Hydraulics Configuration," which is hereby incorporated herein by reference in its entirety. This application also claims benefit of U.S. provisional application Ser. No. 61/038,888 filed Mar. 24, 2008, and entitled "Rock Bit with Vectored Hydraulic Nozzle Retention Sleeves," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to earth-boring bits used to drill a borehole for the ultimate recovery of oil, gas or minerals. More particularly, the invention relates to rolling cone rock bits with improved hydraulics and vectored nozzle retention sleeves.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

An earth-boring bit in common use today is a rock bit including one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones or rolling cone cutters. The borehole is formed as the action of the rotary cones remove chips of formation material.

The earth disintegrating action of the rolling cone cutters is enhanced by providing a plurality of cutting elements on the cutters. Cutting elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are known as "steel tooth bits." In each instance, the cutting elements on the rotating cutters break up the formation to form the new borehole by a combination of gouging and scraping or chipping and crushing.

During drilling operations drilling mud or fluid is pumped to the drill bit through the drillstring, and is ejected from the face of the drill bit through a series of jets or nozzles. The rock fragments and formation cuttings between the cutting elements and along the borehole bottom are flushed away and carried to the surface in the annulus formed between the drill string and borehole by drilling mud or fluid. In particular, the drilling fluid impacts and flows past the cutting structure, and carries the cuttings radially outward on the borehole bottom, and then upward through the annulus to the surface.

In oil and gas drilling, the cost of drilling a borehole is very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer, and which are usable over a wider range of formation hardness.

The length of time that a drill bit may be employed before it must be changed depends upon its rate of penetration ("ROP"), as well as its durability. One design element that significantly affects bit ROP and durability is the hydraulics—the design and layout of the jets and nozzles in the bit face, and the direction and energy of the flow of drilling fluid. For example, when drilling softer formations and plastic formations, there is a strong tendency for formation cuttings to adhere rolling cones and between the cutting elements, a phenomena commonly referred to as "bit balling". When bit balling occurs, the penetration of the individual cutting elements into the formation is limited by the cuttings and fragments stuck to the cones, thereby reducing the amount of formation material removed by the cutting elements and associated reduction in rate of penetration (ROP). In harder clays and shales, cuttings can become impacted or "balled up" between the cutting elements. When formation sticks to cones or is impacted between cutting elements it limits cutting element penetration. Also, formation packed against the cone-shell closes the flow channels needed to carry other cuttings away. This may promote premature bit wear. In either instance, having sufficient fluid directed toward the cones can help to clean the inserts and cones, allowing them to penetrate to a greater depth, maintaining the rate of penetration for the bit. Furthermore, as the inserts begin to wear down, the bit can drill longer since the cleaned inserts will continue to penetrate the formation even in their reduced state. Thus, cuttings must be removed efficiently during drilling to maintain reasonable penetration rates.

Some conventional nozzle arrangements include the placement of a nozzle between each of the cones proximal the outer periphery of the bit or at the center of the bit to channel fluid flow directly to the borehole bottom. However, these arrangements are not desired in many applications where bit balling is a concern because they may not provide sufficient cleaning of the interior rows of cutting elements. In other conventional designs, additional nozzles are positioned over each of the cones which direct a jet stream of fluid directly on top of the cones. The problem with these designs is that the impact of fluid directly on top of the cones may result in severe erosion on the cones and a premature loss of cutting elements from the cone.

Hydraulic optimization in relatively larger bits may be particularly challenging. For example, the greater the hydraulic energy of the drilling fluid, the greater its ability to impact and dislodge formation cuttings from the cutting elements and cones. However, due to diffusion, the hydraulic energy of drilling fluid exiting the bit face generally decreases with distance from the nozzle. For smaller bits, the distance from the exiting nozzle to the cone and cutting elements may be relatively small, and thus, hydraulic energy loss may be minimal. However, for relatively larger bits, the distance traveled by the drilling fluid exiting the nozzles before impacting the cones and cutting elements may be large, resulting in significant hydraulic energy loss and a reduced ability to flush formation cutting. Moreover, for relatively larger bits, the surface area of the cutting structure and the borehole bottom to be cleaned is increased.

In general, modifications to bit hydraulics have generally been difficult to accomplish due to manufacturing and geometric limitations. Usually, bits are constructed using one to three legs that are machined from a forged component. This forged component, called a leg forging, has a predetermined internal fluid cavity or plenum that directs the drilling fluid from the center of the bit to the peripheral jet and nozzle bores. A receptacle for an erosion resistant nozzle is machined into the leg forging, as well as a passageway that is in communication with the internal plenum of the bit. Typically, there is limited flexibility to move the nozzle receptacle location or to change the center line direction of the nozzle receptacle because of the geometrical constraints for the leg forging design.

It may be possible to modify the leg forging design to allow the nozzle receptacle to be machined in different locations depending on the desired flow pattern and hydraulic layout. However, due to the cost of making new forging dies and the expense of inventorying multiple forgings for a single size bit, it may not be cost effective to frequently change the forging to meet the changing needs of the hydraulic designer.

Accordingly, there is a need for bits having an improved bit hydraulics that provide vectored and targeted cleaning for cutting elements along the outer and inner rows of the cones to minimize bit balling without directly impinging the cone shell leading to erosion on the cones. Such improved hydraulics would be particularly well received if they also provided a cost effective and flexible design methodology to optimize hydraulics in the field for specific applications.

BRIEF SUMMARY OF SOME OF THE PREFERRED EMBODIMENTS

These and other needs in the art are addressed in one embodiment by a drill bit for drilling through an earthen formation to form a borehole with a bottom and a sidewall, the drill bit having a full gage diameter with a radius R. In an embodiment, the drill bit comprises a bit body having a central axis, an internal plenum, and an underside generally facing the borehole bottom. The underside includes a central region disposed about the central axis, an annular outer region, and an annular intermediate region radially disposed between the central region and the outer region. The bit body includes an outer receptacle having a central axis and extending from the plenum to the outer region of the underside. In addition, the drill bit comprises a first and a second cone cutter, each of the cone cutters being mounted to the bit body and adapted for rotation about a different cone axis. Each cone cutter comprises an inner region proximal the bit axis, an outer region distal the bit axis, and an intermediate region extending between the inner region and the outer region. The inner region, the intermediate region, and the outer region each include a plurality of cutting elements. Further, the drill bit comprises an outer sleeve having an upstream end, a downstream end, and a through passage extending between the upstream end and the downstream end. The upstream end is coaxially received by the outer sleeve receptacle. The through passage includes an upstream section having an upstream axis and a downstream section having a downstream axis that is skewed at an angle $\alpha$ relative to the upstream axis. A projection of the downstream axis passes between the outer regions of the first and second cone cutters.

Theses and other needs in the art are addressed in another embodiment by a drill bit for drilling an earthen formation, the drill bit having a full gage diameter with a radius R. In an embodiment, the drill bit comprises a bit body having a central axis, an internal plenum, and a underside. In addition, the drill bit comprises a plurality of cone cutters, each of the cone cutters being mounted to the bit body and adapted for rotation about a different cone axis. Further, the drill bit comprises a first receptacle having a central axis and extending from the underside to the plenum of the bit body. Still further, the drill bit comprises a first sleeve having an upstream end, a downstream end, and a through passage extending between the upstream end and the downstream end. The upstream end is coaxially received by the sleeve receptacle. The through passage includes an upstream section having an upstream axis and downstream section having a downstream axis that is skewed relative to the upstream axis.

Theses and other needs in the art are addressed in another embodiment by a drill bit for drilling an earthen formation. In an embodiment, the drill bit comprises a bit body having a central axis and a underside. In addition, the drill bit comprises a plurality of cone cutters, each of the cone cutters being mounted to the bit body and adapted for rotation about a different cone axis. The bit body comprises a plurality of outer receptacle in the underside proximal the outer periphery of the bit body and a plurality of intermediate receptacles in the underside radially positioned between the outer receptacles and the bit axis. Each receptacle has a central axis. Further, the drill bit comprises an outer sleeve at least partially disposed in one of the outer sleeve receptacles. The outer sleeve has a through passage including an upstream section with a upstream axis aligned with the central axis of the outer receptacle and a downstream section with a downstream axis skewed relative to the upstream axis.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
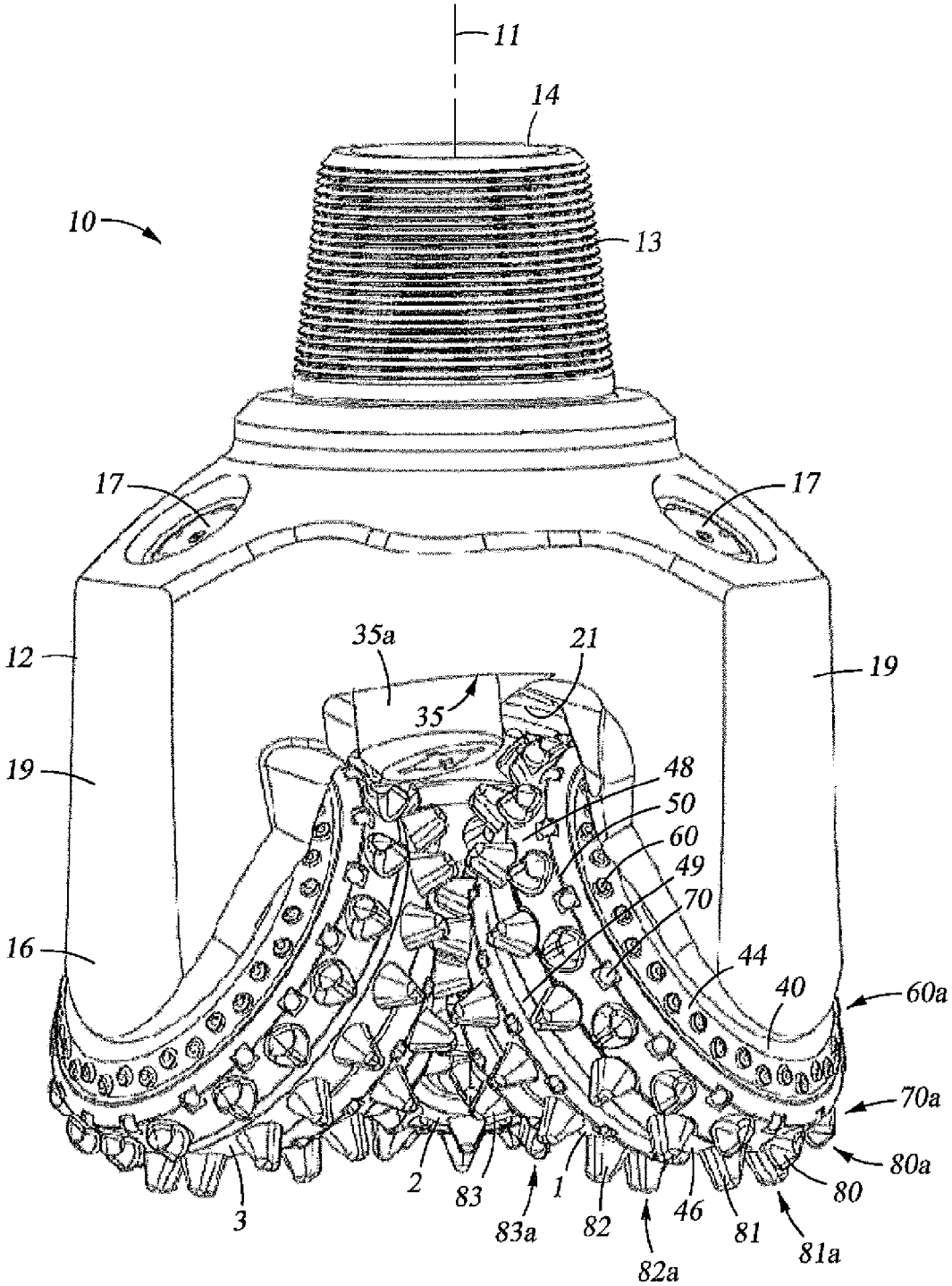
FIG. 1 is a perspective view of an embodiment of an earth-boring bit made in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "radial" and "radially" may be used to described positions, movement, or distances perpendicular to the bit axis, while the terms "axial" and "axially" may be used to describe positions, movement, or distances parallel to the bit axis.

Referring first to FIG. 1, an embodiment of an earth-boring bit 10 made in accordance with the principles described herein is shown. Bit 10 includes a central axis 11 and a bit body 12 having a threaded section 13 at its upper end 14 that is adapted for securing the bit 10 to a drill string (not shown). Bit 10 has a predetermined gage diameter, defined by the outermost reaches of three rolling cone cutters 1, 2, 3 which are rotatably mounted on bearing shafts that depend from the bit body 12. Bit body 12 is composed of three sections or legs 19 that are welded together to form bit body 12. The surface of bit body 12 extending between legs 19 and facing the borehole bottom is generally referred to as the underside 21 of bit 10. As will be described in more detail below, bit 10 further includes a plurality of sleeve receptacles, each with a nozzle retention sleeve disposed therein. The nozzle retention sleeves are each adapted to receive a drilling fluid jet or nozzle. In FIG. 1, one sleeve receptacle 35 including a nozzle retention sleeve 35*a* is shown. In general, the nozzle retention sleeves and nozzles disposed therein direct drilling fluid around cutters 1-3 and toward the bottom of the borehole. Although bit 10 shown in FIG. 1 includes three rolling cone cutters 1, 2, 3, in other embodiments, the bit may include one, two, or more cone cutters.

Bit 10 includes lubricant reservoirs 17 that supply lubricant to the bearings that support each of the cone cutters 1-3. Bit legs 19 include a shirttail portion 16 that serves to protect the cone bearings and cone seals from damage caused by cuttings and debris entering between leg 19 and its respective cone cutter. Although the embodiment illustrated in FIG. 1 shows bit 10 as including three cone cutters 1-3, in other embodiments, bit 10 may include any number of cone cutters, such as one, two, three, or more cone cutters.

Figure 2:
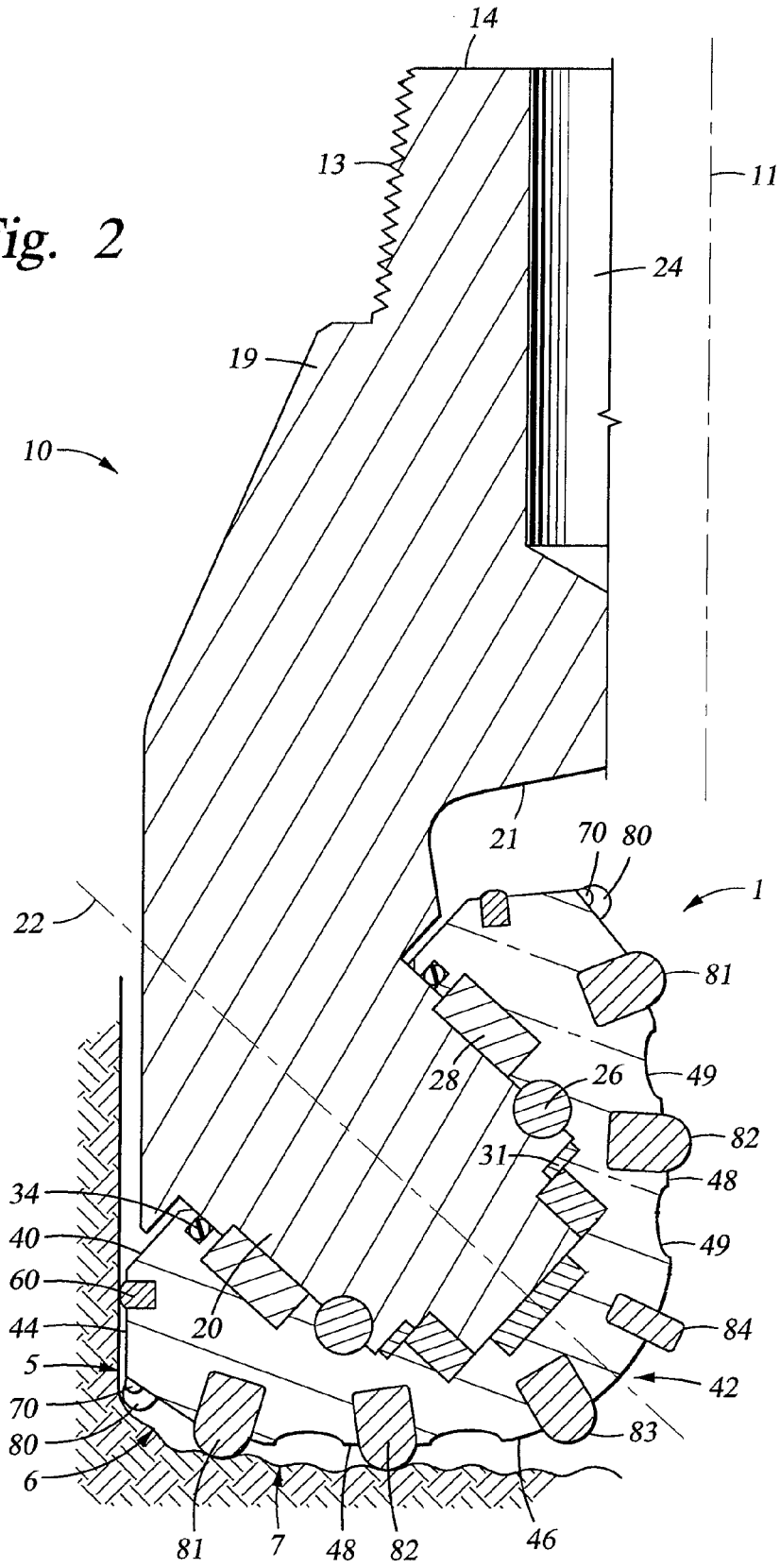
FIG. 2 is a partial section view taken through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial thrust and axial thrust are absorbed by journal sleeve 28 and thrust washer 31. The bearing structure shown is generally referred to as a journal bearing or friction bearing; however, the invention is not limited to use in bits having such structure, but may equally be applied in a roller bearing bit where cone cutters 1-3 would be mounted on pin 20 with roller bearings disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. In other embodiments, an open bearing bit design in which the bearings are not sealed may be employed.

As best shown in FIG. 2, bit body 12 includes an interior fluid passage or plenum 24 which acts as a conduit for drilling fluid. In particular, drilling fluid is pumped from the surface through the drill string to fluid passage 24 where it is circulated through an internal passageway (not shown) to the sleeve receptacles, through the nozzle retention sleeves and the nozzles disposed therein. The borehole created by bit 10 includes sidewall 5, corner portion 6 and bottom 7.

Referring still to FIGS. 1 and 2, each cutter 1-3 includes a generally planar backface 40 and nose 42 generally opposite backface 40. Adjacent to backface 40, cutters 1-3 further include a generally frustoconical surface 44 that is adapted to retain cutting elements that scrape or ream the sidewalls of the borehole as the cone cutters 1-3 rotate about the borehole bottom. Frustoconical surface 44 will be referred to herein as the "heel" surface of cone cutters 1-3, it being understood, however, that the same surface may be sometimes referred to by others in the art as the "gage" surface of a rolling cone cutter. A generally conical surface 46 extends between heel surface 44 and nose 42.

Extending between heel surface 44 and nose 42 is a generally conical cone surface 46 adapted for supporting cutting elements that gouge or crush the borehole bottom 7 as the cone cutters rotate about the borehole. Frustoconical heel surface 44 and conical surface 46 converge in a circumferential edge or shoulder 50. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions 48, generally referred to as "lands", which are employed to support and secure the cutting elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extend to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart first, second, and third inner rows 81*a*, 82*a*, 83*a*, respectively. First inner row 81*a* adjacent gage row 80*a* may also be referred to as the "drive row."

Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action of gage inserts 80 thereby preventing gage inserts 80 from wearing as rapidly as might otherwise occur. Inner row cutter elements 81, 82, 83 of inner rows 81*a*, 82*a*, 83*a* are employed to gouge and remove formation material from the remainder of the borehole bottom 7, and thus, may also be referred to here in as "bottomhole" cutting elements.

Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs between the three cones in order to maximize borehole bottom coverage, and also to provide clearance for the cutter elements on the adjacent cone cutters.

In the embodiment shown, inserts 60, 70, 80-83 each includes a generally cylindrical base portion, a central axis, and a cutting portion that extends from the base portion, and further includes a cutting surface for cutting the formation material. The base portion is secured by interference fit into a mating socket drilled into the surface of the cone cutter. In general, the cutting surface of an insert refers to the surface of the insert that extends beyond the surface of the cone cutter.

In some drilling applications, such as the drilling of carbonates in the Middle East, the relatively close spacing of cutting elements 80, 81 on cones 1-3 causes rows 80*a*, 81*a* to experience "balling" or "balling-up" of cuttings between them. Balling also tends to occur on other places on cones 1-3, such as between inner rows 81*a*, 82*a*, 83*a*. When bit balling occurs, it impedes the progress and ROP of the bit by preventing the cutting elements from penetrating completely into the earth formation.

Figure 3:
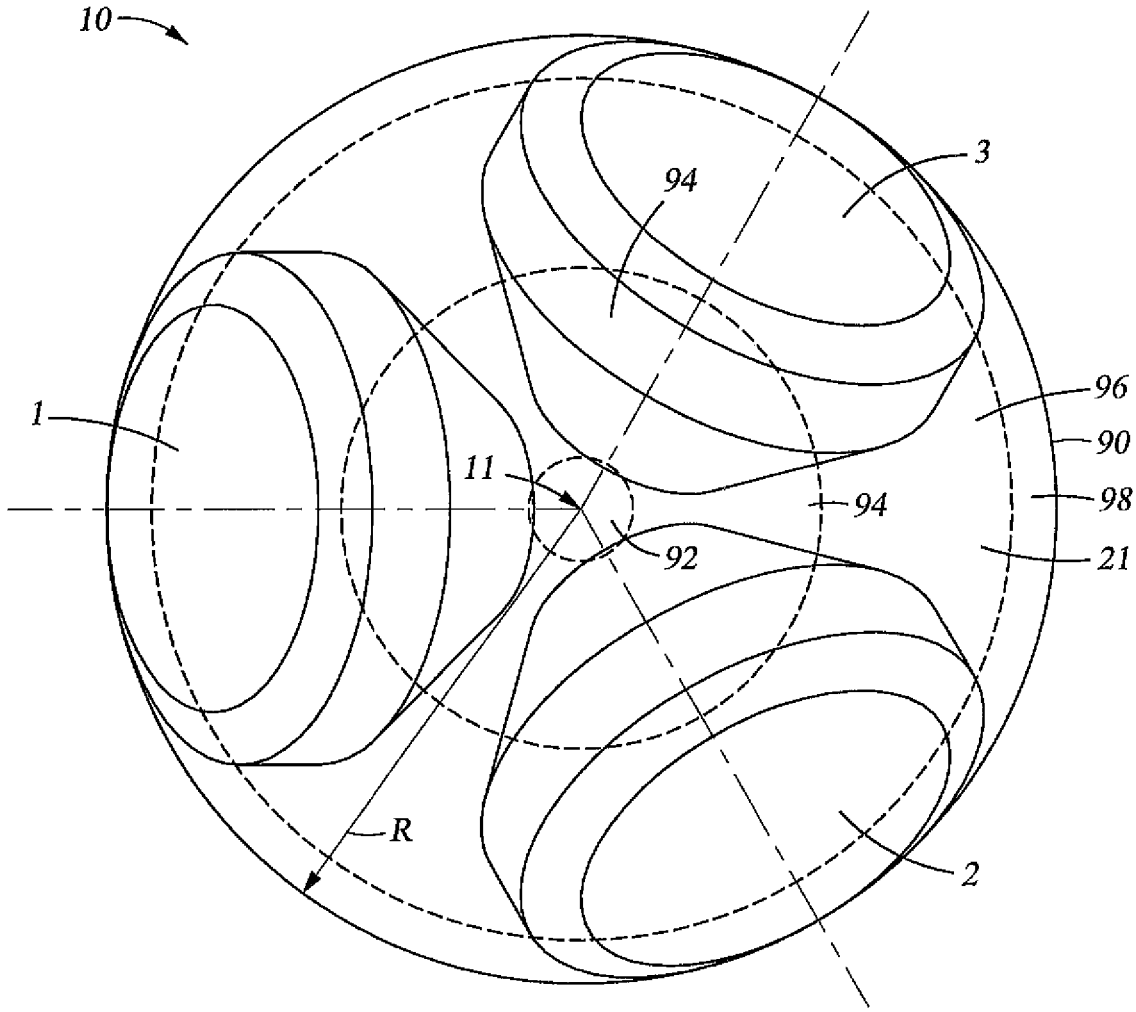
FIG. 3 is a schematic bottom end view of the rolling cone cutters of FIG. 1 indicating the central, intermediate, outer, and gage regions of the bit.

FIG. 3 is a schematic bottom view of cones 1-3. The radially outermost reaches of cones 1-3 and cutter elements mounted therein (e.g., cutter elements 60, 70, 80, 81, 82, 83) define the full gage diameter of bit 10 represented by line 90. The full gage diameter 90 defines the bit radius R measured radially from bit axis 11. For purposes of the discussion below, the bottom of bit 10 and underside 21 may be divided into a plurality of annular regions between bit axis 11 and the full gage diameter 90. In particular, bit 10 may be described as having a central region 92 extending radially from bit axis 11 to about 10% of the bit radius R. Moving radially outward, bit 10 also includes an intermediate region 94 extending from central region 92 to about 50% of the bit radius R, an outer region 96 extending from intermediate region 94 to about 90% of the bit radius R, and a gage region 98 extending from outer region 96 to full gage diameter 90 and 100% of the bit radius R. Central region 92 and intermediate region 94 may collectively be referred to as the "dome region."

Figure 4:
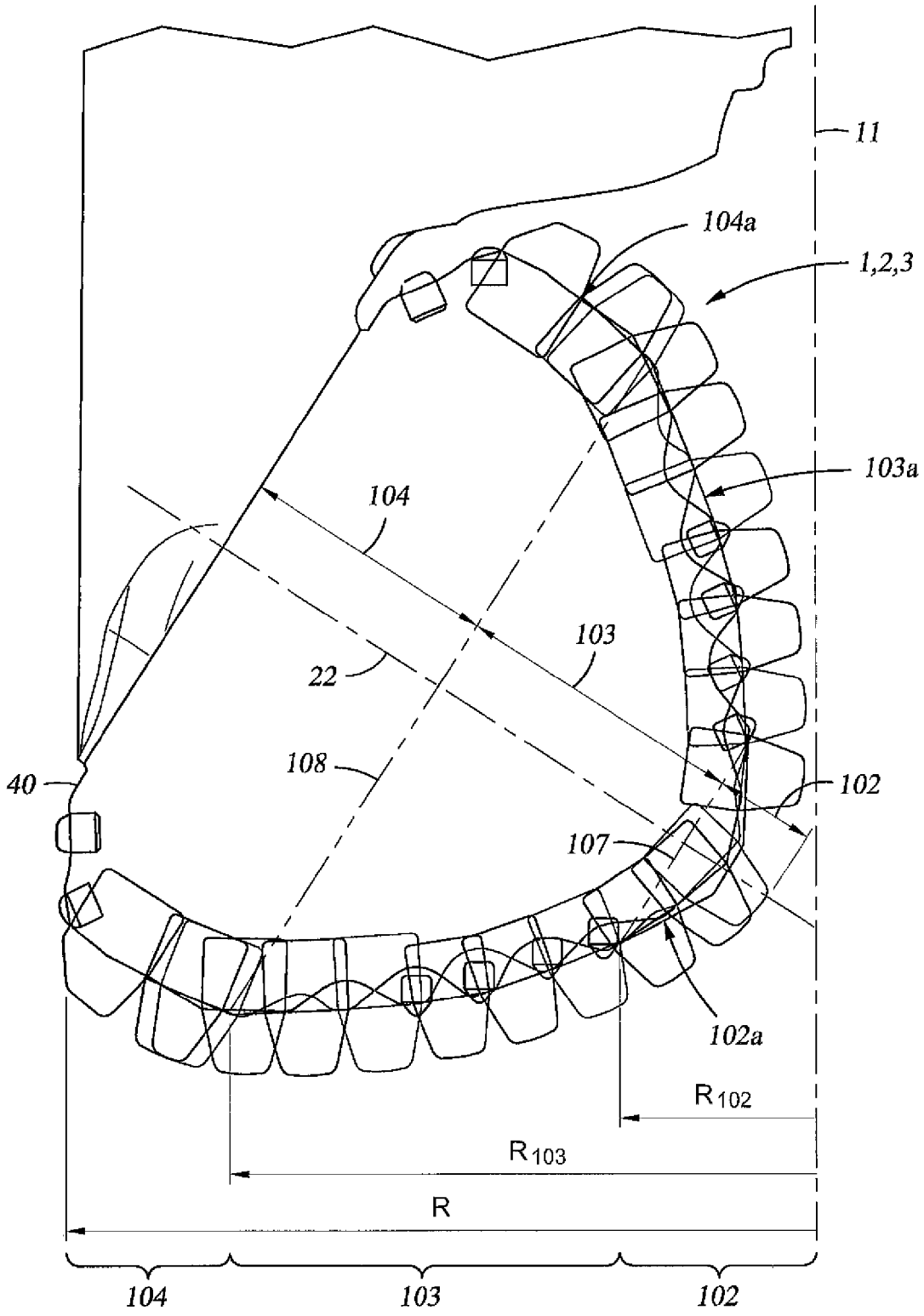
FIG. 4 is a partial view showing, schematically and in rotated profile, the cutting profiles of all of the cutting elements of the three cone cutters of the drill bit shown in FIG. 1.

Referring briefly to FIG. 4, the profiles of all three cones 1-3 and associated cutting elements are shown rotated into a single profile termed herein the "composite rotated profile view." In the composite rotated profile view, the overlap of the profiles of cutting elements within a row is shown, as well as the overlap of different rows that are positioned on different cones. Consequently, the composite rotated profile view illustrated in FIG. 4 illustrates the bottomhole coverage of the entire bit 10.

Figure 5:
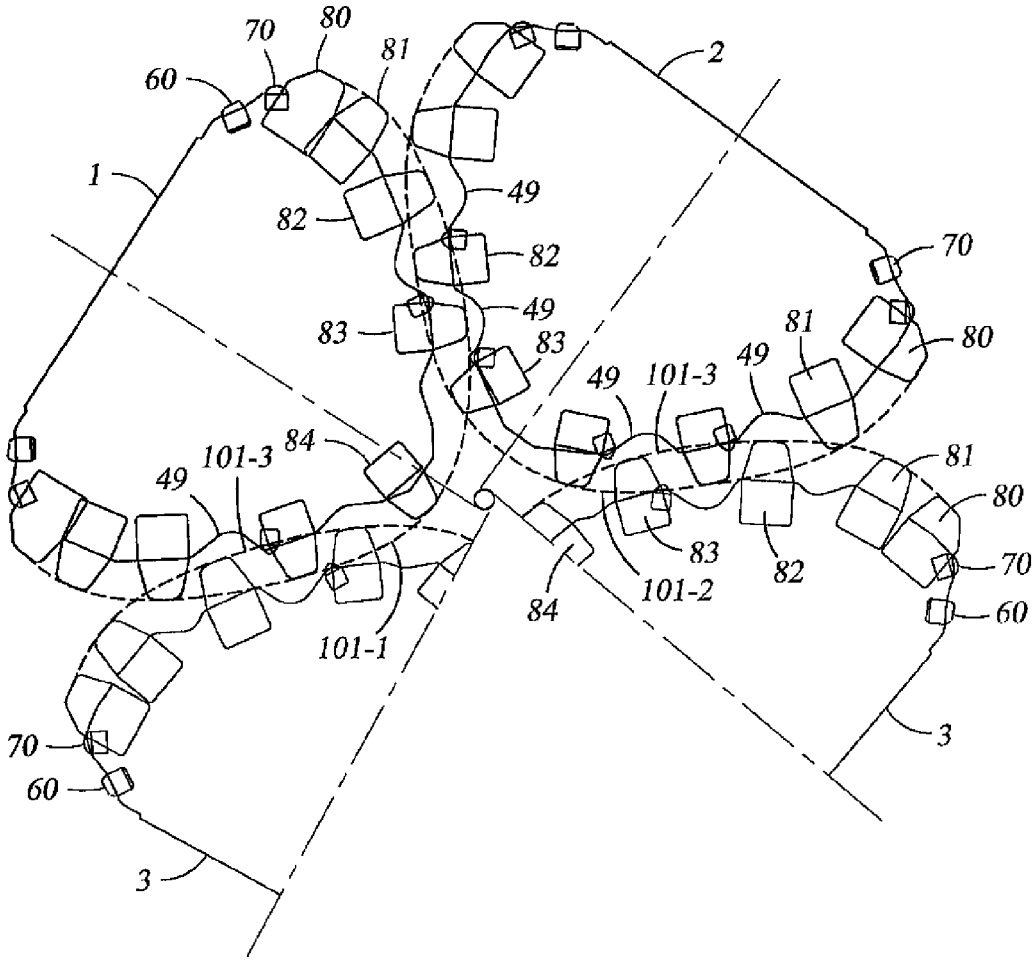
FIG. 5 is a schematic representation showing the intermesh of the three rolling cones of the bit shown in FIG. 1.

Referring now to FIG. 5, the intermeshed relationship between the cones 1-3 is shown. In this view, commonly termed a "cluster view," cone 3 is schematically represented in two halves so that the intermesh between cones 2 and 3 and between cones 1 and 3 may be simultaneously depicted. The term "intermesh" as used herein is defined to mean overlap of any part of at least one cutter element on one cone cutter with the envelope defined by the maximum extension of the cutter elements on an adjacent cutter. As shown in FIG. 5, each cone cutter 1, 2, 3 has an envelope 101-1, 101-2, 101-3, respectively, defined by the maximum extension height of the cutter elements on that particular cone. The cutter elements that "intersect" or "break" the envelope 101-1, 101-2, 101-3 of an adjacent cone "intermesh" with that adjacent cone. For example, cutting elements 82, 83 of cone 1 break envelope 101-2 of cone 2, and break envelope 101-3 of cone 3 and therefore intermeshes with both cone 2 and cone 3. However, cutting elements 60, 70, 80, 81 and 84 of cone 1 do not break envelope 101-2 or 101-3, and therefore, do not intermesh with either cone 2 or cone 3. Similarly, cutting elements 82, 83 of cone 3 break envelope 101-1 of cone 1, and break envelope 101-2 of cone 2 and therefore intermeshes with both cone 1 and cone 2, while cutting elements 60, 70, 80, 81, and 84 of cone 3 do not intermesh with either cone 1 or cone 2. Still further, cutting elements 81, 82, 83 of cone 2 break envelope 101-1 of cone 1, and break envelope 101-3 of cone 3 and therefore intermeshes with both cone land cone 3, while cutting elements 60, 70, 80 of cone 2 do not intermesh with either cone 1 or cone 3.

The intermeshing arrangement of cones 1-3 is also desirable to reduce balling. As a row of cutting elements of one cone intermesh between the rows of cutting elements of another cone, it dislodges balling between the rows of cutting elements on the adjacent cone. As shown in FIG. 4, grooves 49 allow the cutting surfaces of certain cutting elements of adjacent cone cutters 1-3 to pass between the cutting elements of adjacent cones 1-3 without contacting cone surface 46 of the adjacent cone cutter 1-3. In some cases, selected cutting elements may be arranged to intermesh over 50% of their length, wherein an intermeshed cutting element of one cone is overlapped over 50% of its length by a cutting element from an adjacent cone.

Moreover, having intermesh allows the diameter of the cones to be larger, providing for a larger bearing surface which results in a more durable cone. In general, performance expectations of rolling cone bits typically require that the cone cutters be as large as possible within the borehole diameter so as to allow use of the maximum possible bearing size and to provide a retention depth adequate to secure the cutter element base within the cone steel. Intermeshing cutting elements of adjacent cones offers the potential to achieve maximum cone cutter diameter and still have acceptable insert retention and protrusion.

As best shown in FIG. 4, moving axially along cone axis 22 from proximal bit axis 11 toward backface 40, each cone 1-3 may each be divided into three bands or regions—an inner region 102, an intermediate region 103, and an outer region 104. Inner region 102 is disposed 360° about cone axis 22 and extends axially (relative to cone axis 22) from proximal bit axis 11 to a first boundary 107 and intermediate region 103. Intermediate region 103 is disposed 360° about cone axis 22 and extends axially (relative to cone axis 22) from first boundary 107 and inner region 102 to a second boundary 108 and outer region 104. Outer region 104 is disposed 360° about cone axis 22 and extends from second boundary 108 and intermediate region 103 to cone backface 40.

Intermediate region 103 has an associated cone shell surface 103*a*, and in this embodiment, generally includes all of the intermeshing cutting elements (e.g., cutting elements 82, 83). Inner region 102 has an associated cone shell surface 102*a* including nose 42, and in this embodiment, generally includes the radially inner (relative to bit axis 11) non-intermeshing cutting elements (e.g., cutting elements 84). Outer region 104 has an associated cone shell surface 104*a*, and in this embodiment, generally includes the radially outer (relative to bit axis 11) non-intermeshing cutting elements (e.g., gage cutting elements 80 and first inner row cutting elements 81).

Referring still to FIG. 4, relative to the borehole bottom and the position of the cutting elements at their lowermost position (i.e., at bottom dead center), inner region 102 extends radially (relative to bit axis 11) from proximal bit axis 11 to an first radius R102, intermediate region 103 extends radially (relative to bit axis 11) from inner region 102 to a second radius R103, and outer region 104 extends radially (relative to bit axis 11) from intermediate region 103 to bit radius R previously described with reference to FIG. 3. In this embodiment, first radius R102 is about 25% of bit radius R, and second radius R103 is about 75% of bit radius R.

Figure 6:
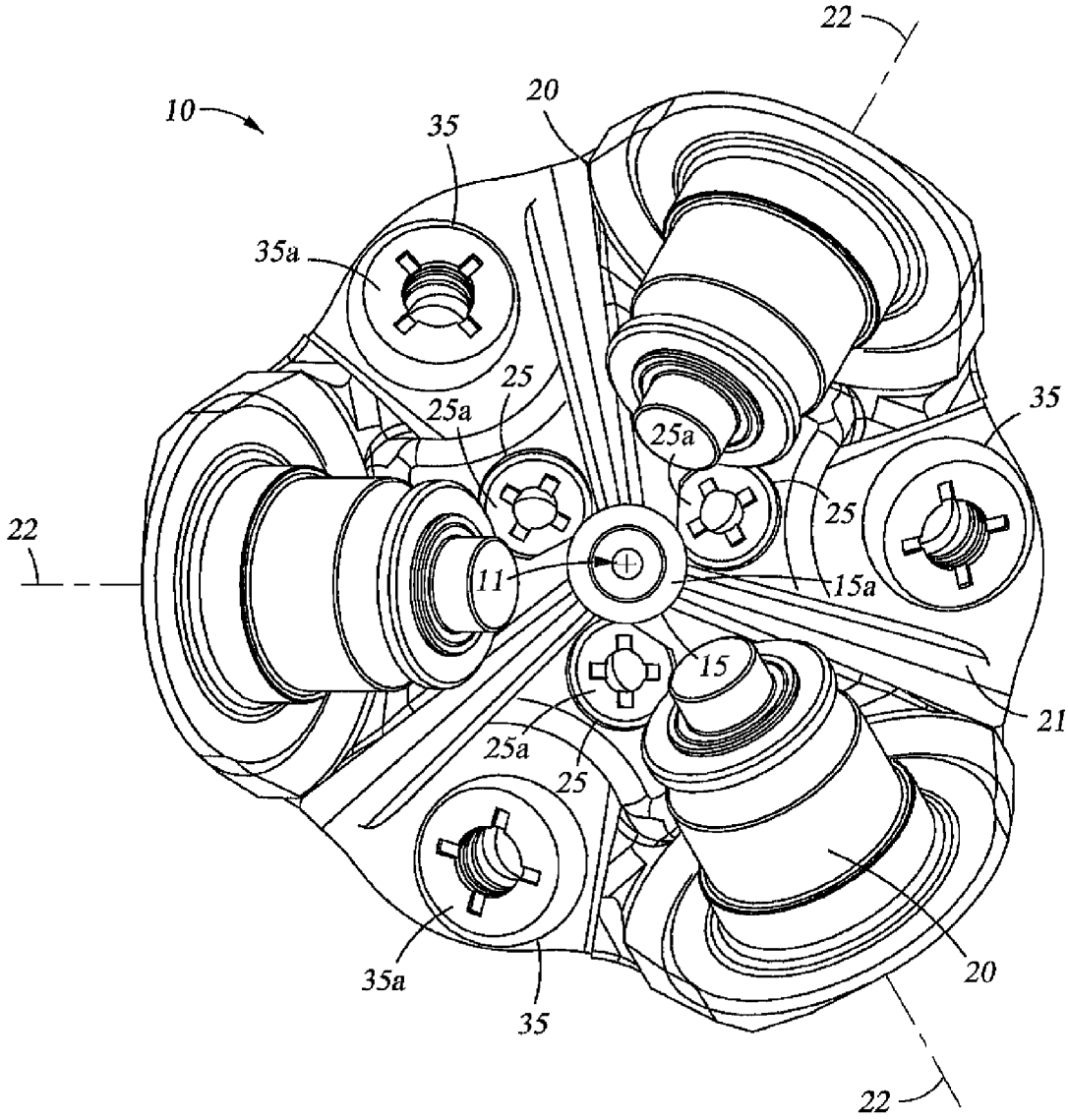
FIG. 6 is a bottom end view of the bit of FIG. 1 with the cones and cutting structure omitted for clarity purposes.
Figure 7:
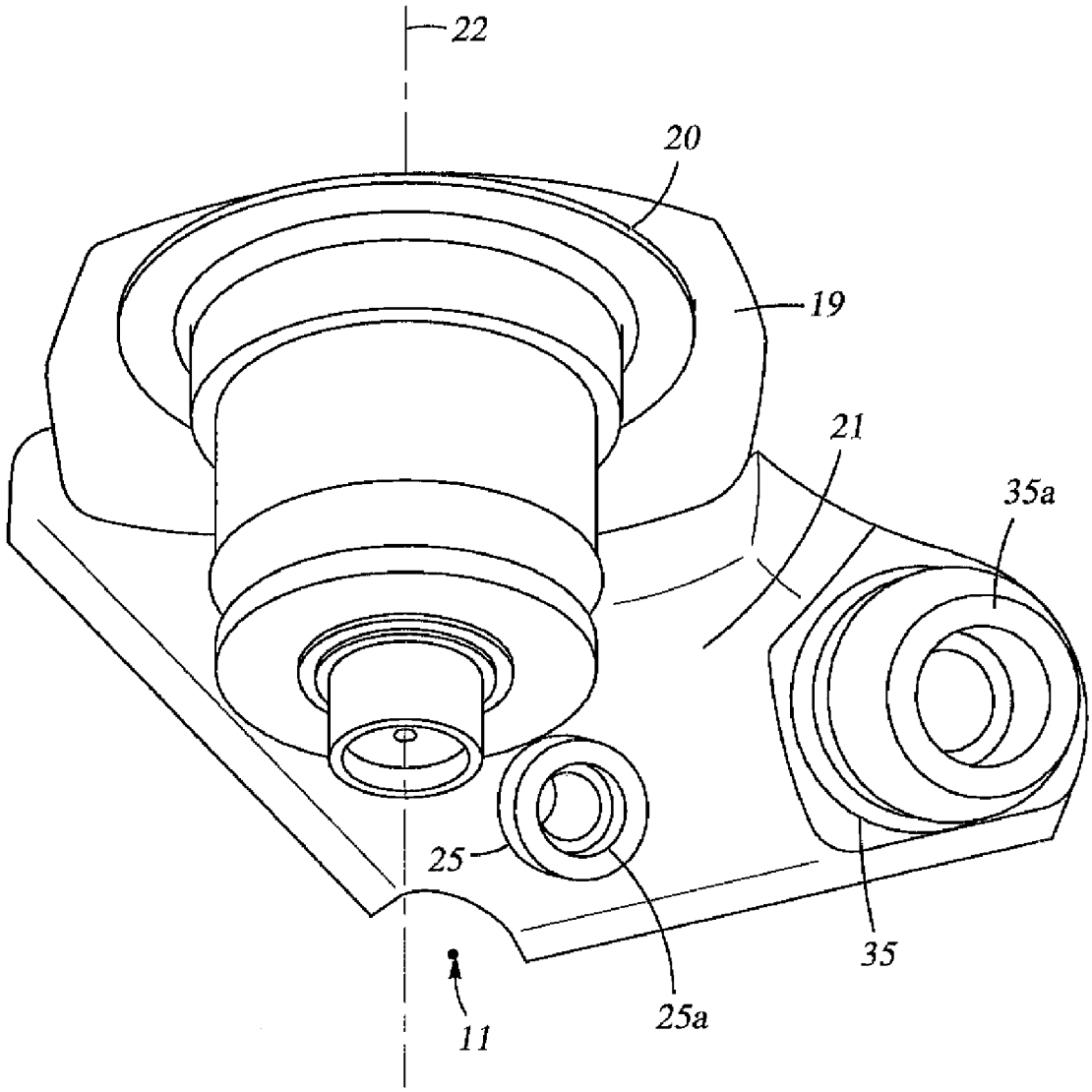
FIG. 7 is a bottom end view of one of the legs of the bit of FIG. 1.
Figure 8:
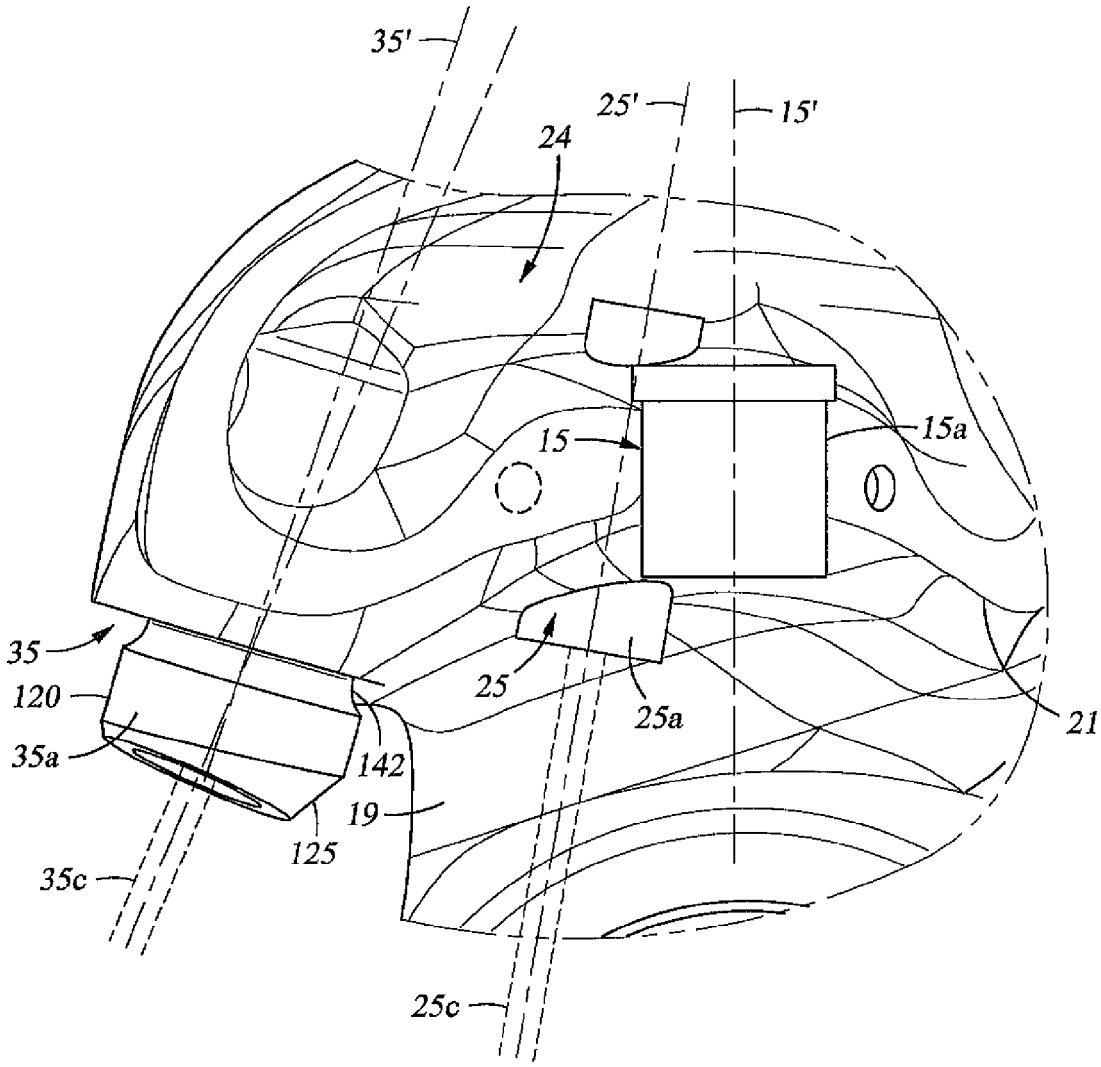
FIG. 8 is a side view of one of the legs of the bit of FIG. 1.

Referring now to FIGS. 6-8, the design and layout of the hydraulics of bit 10 are shown. For purposes of clarity, cones 1-3 and the cutting elements mounted thereon are omitted from FIG. 6.

In this embodiment, bit 10 includes a central sleeve receptacle 15, a plurality of intermediate sleeve receptacles 25, and a plurality of outer sleeve receptacles 35. As used herein, the phrase "sleeve receptacle" may be used to refer to a receptacle in the bit body that receives a sleeve. As will be explained in more detail below, each sleeve is adapted to receive a jet or nozzle in its downstream end. In other words, a sleeve is employed to couple a jet or nozzle to a sleeve receptacle.

Central sleeve receptacle 15 is positioned proximal the center of underside 21 within central region 92 previously described. Outer sleeve receptacles 35 are positioned at the outer periphery of underside 21 within outer region 96 previously described. Intermediate sleeve receptacles 25 are positioned radially between central sleeve receptacle 15 and outer sleeve receptacles 35 within intermediate region 94 previously described. An exemplary bit designed in accordance with this aspect and having a diameter of 17.5 inches includes three outer sleeve receptacles (e.g., outer sleeve receptacles 35), each radially positioned at about 70% of the bit radius and three intermediate nozzle receptacles (e.g., intermediate sleeve receptacles 25), each radially positioned at about 26% of the bit radius. In other embodiments, the intermediate nozzle receptacles may be radially positioned between 25% and 30% of the bit radius, and the outer sleeve receptacles may be radially positioned radially between 60% and 75% of the bit radius.

In this embodiment, intermediate sleeve receptacles 25 are uniformly spaced about 120° apart about bit axis 11, and outer sleeve receptacles 35 are uniformly spaced about 120° apart about bit axis 11. However, in other embodiments, one or more of the intermediate nozzle receptacles, the outer sleeve receptacles, or combinations thereof may be spaced differently.

Although a central sleeve receptacle (e.g., central sleeve receptacle 15) is included in this embodiment, in other embodiments, the central sleeve receptacle may be omitted. Inclusion of a central sleeve receptacle may be dictated by a variety of factors including, without limitation, the size of the bit. For example, in relatively larger bits (e.g., bits a diameter greater than about 12.25 inches), there may be sufficient space on the underside (e.g., underside 21) for a central sleeve receptacle, intermediate sleeve receptacles (e.g., intermediate sleeve receptacles 25), and outer sleeve receptacles (e.g., outer sleeve receptacles 35). However, as the bit diameter decreases (e.g., bits having a diameter less than 12.25 inches), the intermediate sleeve receptacles are often moved radially inward toward the bit axis. If the intermediate sleeve receptacles are moved sufficiently inward, there may not be adequate space to include a central sleeve receptacle.

As best shown in FIG. 7, each bit leg 19 includes one intermediate sleeve receptacle 25 and one outer sleeve receptacle 35. On a given leg 19, sleeve receptacles 25, 35 are laterally offset and angularly spaced from the cone or journal axis 22 relative to the bit axis 11. The radially innermost portion of each leg 19 defines a portion of central sleeve receptacle 15. Upon assembly of legs 19 to form bit body 12, one intermediate sleeve receptacle 25 and one outer sleeve receptacle 35 is circumferentially positioned between cone or journal axes 22 of adjacent cones 1-3. Further, upon assembly of legs 19 to form bit body 12, central sleeve receptacle 15 is formed by the radially innermost portions of legs 19.

In general, each leg 19 may be formed by conventional manufacturing techniques. Once leg 19 is formed, sleeve receptacles 25, 35 may be drilled or bored into leg 19. It should be appreciated that intermediate sleeve receptacles 25 are in close proximity to finished journal pin 20. Consequently, the drilling or boring operation to form receptacles 25 is preferably performed with great care and attention to avoid damaging the journal surface.

In this embodiment, each receptacle 15, 25, 35 is a substantially straight, cylindrical bore having a single central axis. However, in other embodiments, one or more receptacles (e.g., receptacles 15, 25, 35) may include a turn or bend. In other words, in other embodiments, one or more receptacles may have a first section with a first central axis and a second section with a second central axis that is skewed relative to the first central axis.

Referring still to FIGS. 6-8, a central sleeve 15*a* is at least partially disposed in central sleeve receptacle 15, an intermediate sleeve 25*a* is at least partially disposed in each intermediate sleeve receptacle 25, and an outer sleeve 35*a* is at least partially disposed in each outer sleeve receptacle 35. In this embodiment, the geometry of the inserted portion of each sleeve 15*a*, 25*a*, 35*a* is adapted to mate with the geometry of its respective receptacle 15, 25, 35. In this particular embodiment, receptacles 15, 25, 35 are cylindrical, and thus, the inserted portions of sleeves 15*a*, 25*a*, 35*a*, respectively, are also cylindrical. However, other suitable geometries and shapes may be employed for the sleeves and receptacles. In general, each sleeve 15*a*, 25*a*, 35*a* may be secured in mating sleeve receptacle 15, 25, 35, respectively, by any suitable means including, without limitation, threading, press-fitting, welding, and retention by snap rings. However, to form a rigid connection capable of withstanding extreme downhole drilling conditions, sleeves 15*a*, 25*a*, 35*a* are preferably positioned in mating receptacles 15, 25, 35, respectively, and then welded to bit body 12 from dome side 21.

As best shown in FIG. 8, once positioned in receptacles 15, 25, 35, each sleeve 15*a*, 25*a*, 35*a* has an upstream end in fluid communication with plenum 24 and a downstream end extending from underside 21 of bit body 12. In this embodiment, central sleeve 15*a* and intermediate sleeves 25*a* are generally flush with bit body 12, however, outer sleeves 35*a* extend from bit body 12.

Figure 12A:
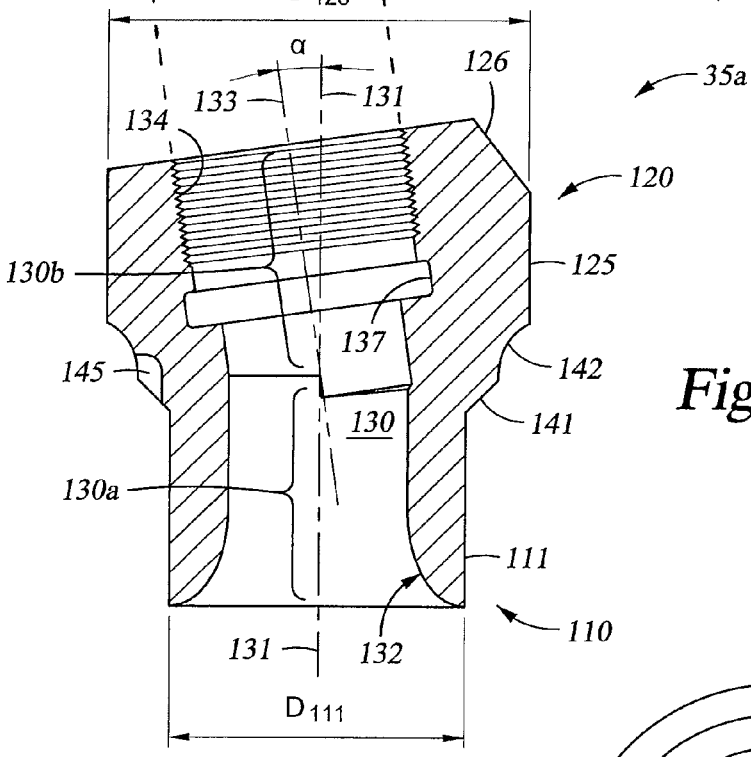
FIG. 12*a* is a cross-sectional view of the outer sleeve of FIG. 11 taken along line A-A.

Prior to drilling, a jet or nozzle 200 is disposed in the downstream end of each sleeve 15*a*, 25*a*, 35*a* (see FIG. 12A). Consequently, each sleeve 15*a*, 25*a*, 35*a* may also be referred to as "nozzle retention sleeve." In general, each nozzle may be secured within the downstream end of its mating nozzle retention sleeve (e.g., sleeve 15*a*, 25*a*, 35*a*) by any suitable means including, without limitation, mating threads, press-fitting, welding, snap rings, or combinations thereof. Each nozzle is preferably releasably received by its mating nozzle retention sleeve such that the nozzles may be replaced or changed in the field depending on the desired flow rate through each nozzle and desired flow pattern. In some embodiments, one or more of the sleeves (e.g., central sleeve 15*a*) may be "blanked," such that the downstream end of the sleeve is completely closed off, thereby preventing the flow of drilling fluid through the sleeve.

For purposes of the following explanation, the nozzles secured within outer sleeves 35*a* will be referred to as "outer nozzles," the nozzles secured within intermediate sleeves 25*a* will be referred to as "intermediate nozzles," and the nozzle secured within central sleeve 15*a* will be referred to as the "central nozzle." In general, the outer nozzles, the intermediate nozzles, and the central nozzle may be any suitable type of nozzle including, without limitation, straight bore nozzles, multistage nozzles, diffusing nozzles, etc. In a straight bore nozzle, the area of the nozzle throat is generally the same size as the nozzle outlet. In a multistage nozzle, the upstream portion of the nozzle has a converging section and the downstream end includes a distributor having a plurality of exit holes, usually three exit holes. Drilling fluid flowing through a multistage nozzle is accelerated towards the distributor, where the fluid flow is divided into multiple streams by the distributor, which may target different areas of the bit and/or borehole. Due to impingement with the distributor, streams of drilling fluid exiting a multistage nozzle tend to have lower velocities and energy, and thus, generally present a reduced likelihood of causing cone erosion. A variety of multistage nozzles are described in U.S. Pat. Nos. 6,585,063 and 7,188,682, each of which is incorporated herein by reference in its entirety. In a diffusing nozzle, the outlet portion diverges from a smaller diameter portion within the orifice. Consequently, drilling fluid exiting a diffuser nozzles diffuses and diverges so as to potentially cover an increased target cleaning area. A variety of diffusion nozzles are described in U.S. Pat. No. 5,601,153, which is hereby incorporated herein by reference in its entirety. Since cone shell erosion and associated premature loss of cutting elements is more likely with streamlined or culminated flow, the outer nozzles and intermediate nozzles are preferably diffuser nozzles, and the central nozzle is preferably a diffuser nozzle or multistage nozzle. Each nozzle is preferably formed of a wear resistant material such as cemented tungsten carbide.

Without being limited by this or any particular theory, the greater the nozzle orifice diameter (or the sum of the orifice diameters in a multistage nozzle), the greater the drilling fluid volumetric flow through the nozzle. Thus, the orifice diameters of the nozzles may be sized or selected to provide the desired drilling fluid flow allocation through the plurality of nozzles. In embodiments described herein, the nozzle orifice diameters are preferably selected to provide a drilling fluid flow allocation ranging from 45% to 80% through the outer nozzles and a drilling fluid flow allocation ranging from 20% to 55% through the intermediate nozzles, and more preferably 55% to 70% through the outer nozzles and 30 to 45% through the intermediate nozzles. In embodiments including a center nozzle, preferably at least 10% of the drill fluid flow will be directed through the center nozzle to alleviate bit balling near the center of the cones and/or to ensure that the fluid or mud flow carrying cuttings will flow radially outward from the center of the borehole and up the annulus formed between the bit and the borehole.

Figure 9:
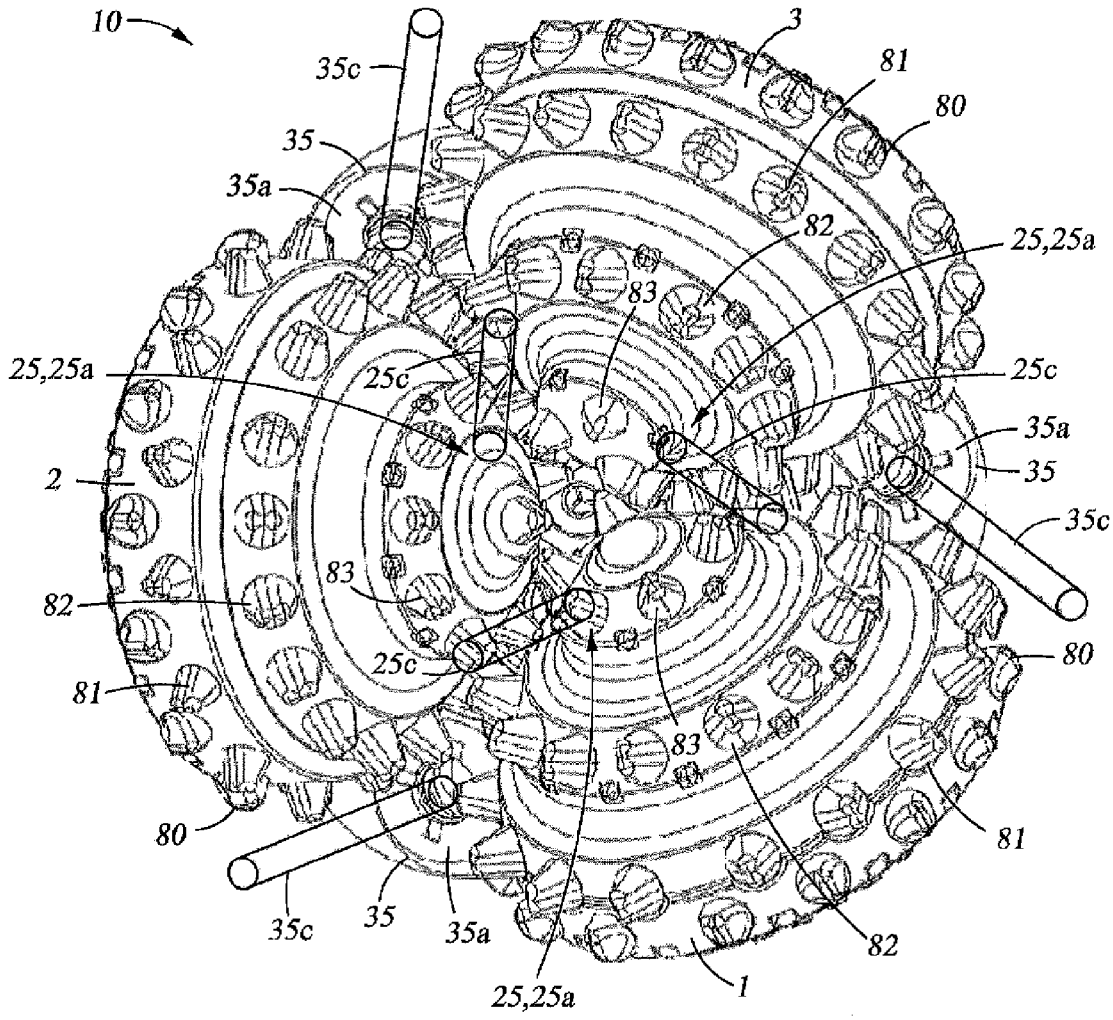
FIG. 9 is a bottom end view of the bit of FIG. 1 illustrating the exiting centerlines of the sleeves.
Figure 10:
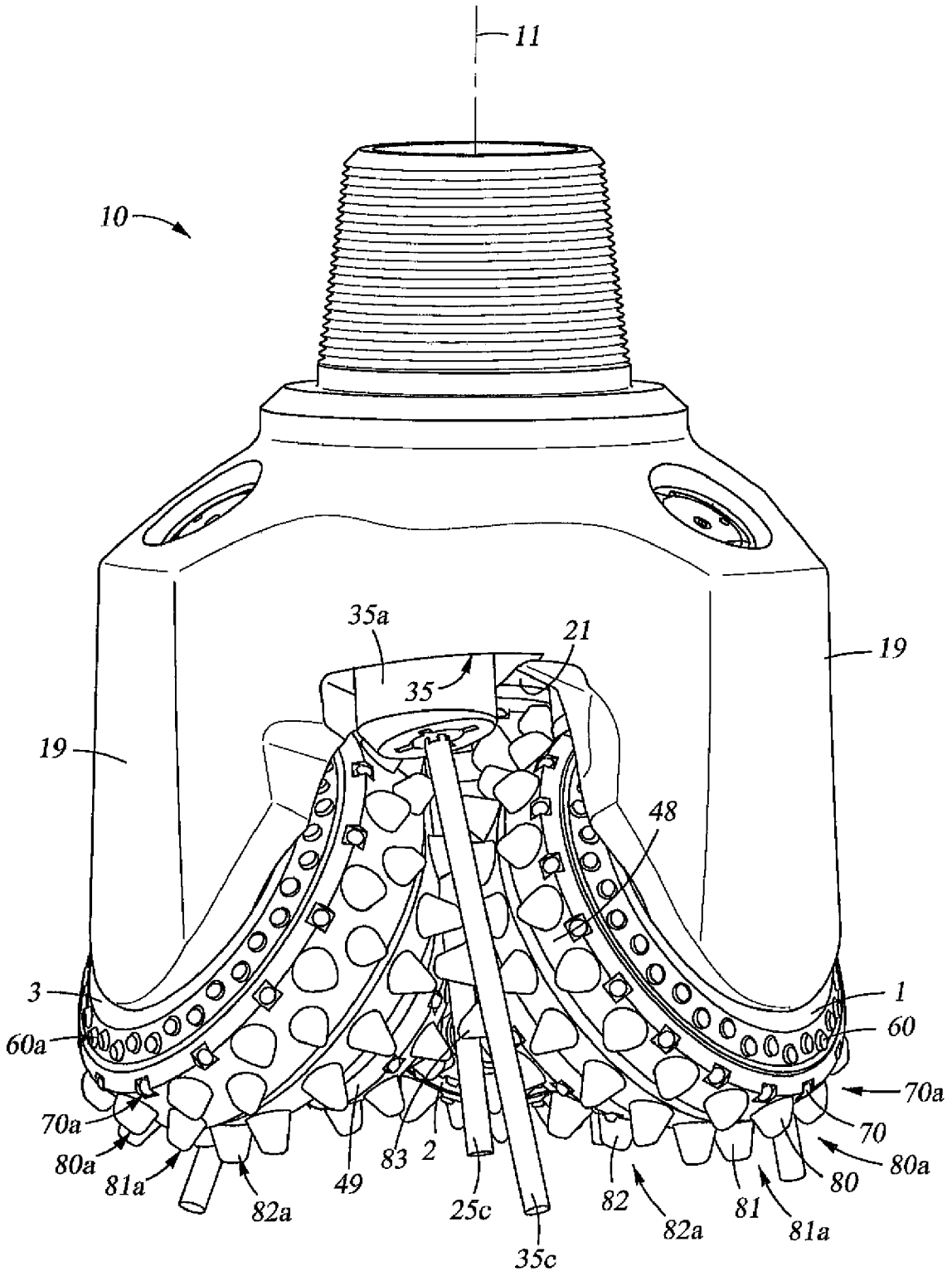
FIG. 10 is an enlarged side view of the bit of FIG. 1 illustrating the exiting centerlines of the sleeves.

Referring now to FIGS. 9 and 10, the stream or trajectory of drilling fluid exiting each sleeve 25*a*, 35*a* and associated nozzle (not shown) is illustrated. For purposes of clarity, the stream or trajectory of drilling fluid exiting center sleeve 15*a* and associated center nozzle are not shown. Although the jet or stream of drilling fluid ejected from each sleeve 25*a*, 35*a* and associated nozzle behaves in a complex manner, the general direction and orientation of discharged drilling fluid is generally represented by a projected centerline 25*c*, 35*c*, respectively, to simplify the discussion to follow. Thus, centerlines 25*c*, 35*c* generally indicate the stream or trajectory of drilling fluid exiting sleeves 25*a*, 35*a*, respectively, through the nozzles disposed therein. Although intermediate receptacles 25 and intermediate sleeves 25*a* are disposed beneath cones 1-3, and thus, are not visible in FIG. 9, their general location has been labeled so that the starting point of each centerline 25*c* is clear.

As indicated by each centerline 35*c*, outer sleeves 35*a* and associated nozzles are generally positioned and oriented to direct drilling fluid between outer regions 104 of each pair of adjacent cones 1-3. In particular, each outer sleeve 35*a* and associated nozzle is positioned and oriented such that each stream of drilling fluid represented by centerline 35*c* is directed towards the cutting elements in outer regions 104 of each pair of adjacent cones 1-3. In particular, the stream of drilling fluid represented by centerline 35*c* first strikes the tips of gage cutting elements 80 and inner row cutter elements 81 in outer regions 104, and then strikes the radially outer portion of the borehole bottom. In this embodiment, outer sleeves 35*a* and associated nozzles (and hence centerlines 35*c*) are slightly angled toward the leading side of cones 1-3. As used herein, the phrase "leading side" may be used to refer to the side of a cone cutter that is rotating towards and into the formation, whereas the term "trailing side" may be used to refer to the side of a cone cutter that is rotating out of and away from the formation.

As indicated by centerlines 25*c*, intermediate sleeves 25*a* and associated nozzles are generally positioned and oriented to direct drilling fluid between intermediate regions 103 of each pair of adjacent cones 1-3. In particular, intermediate sleeves 25*a* and associated nozzles are positioned and oriented such that the stream of drilling fluid represented by centerline 25*c* is directed towards the cutting elements in intermediate regions 103 of each pair of adjacent cones 1-3. The stream of drilling fluid represented by centerline 25*c* first strikes cutting elements 82, 83 in inner rows 82*a*, 83*a*, and then strikes the borehole bottom.

In the manner described, receptacles 25, 35, sleeves 25*a*, 35*a*, and associated nozzles are generally positioned and oriented to direct drilling fluid across the cutting elements in outer regions 104 (e.g., cutting elements 80, 81 in radially outer rows 80*a*, 81*a*, respectively), the cutting elements in intermediate regions 103 (e.g., cutting elements 81, 82 in radially inner rows 81*a*, 82*a*, respectively), and the borehole bottom. Further, receptacles 25, 35, sleeves 25*a*, 35*a*, and associated nozzles are positioned and oriented to direct drilling fluid flow between adjacent cones 1-3 in a generally downward direction toward the borehole bottom, thereby minimizing impingement of cones 1-3. As a result, embodiments described herein offer the potential to provide improved cleaning of both radially inner and radially outer cutter elements, and reduced likelihood of undesirable erosion of cones 1-3. In addition, by reducing impingement of cones 1-3, embodiments described herein also offer the potential to enhance the energy and impact force of the drilling fluid flowing across the cutting elements to the borehole bottom. A more detailed description of the drilling fluid centerlines and projections exiting bit body 12 is provided in U.S. Provisional Patent Application Ser. No. 60/979,806, which is hereby incorporated herein by reference in its entirety.

Although intermediate receptacles 25 and intermediate sleeves 25*a* are described as being positioned and oriented to direct drilling fluid toward the cutting elements between each pair of adjacent cones 1-3 to reduce the potential for cone erosion, in other embodiments, the intermediate receptacles (e.g., intermediate receptacles 25) and associated intermediate sleeves (e.g., intermediate sleeves 25*a*) may be positioned and oriented to direct drilling fluid toward the cone shell surface (e.g., cone shell surface 102*a*, 103*a*, 104*a*) of one of the cone cutters between which the intermediate sleeve is disposed. For example, in cases of extreme bit balling, it may be desirable to increase the hydraulic energy on the cone shell surface to enhance the cone cleaning capabilities. In such embodiments, the projection of the drilling fluid exiting the intermediate sleeve may directly intersect or impact the cone shell surface of one of the cones between which the intermediate sleeve is disposed in order to disburse significantly more hydraulic energy on that cone shell surface than the adjacent cone shell surface. This offers the potential for increased cone cleaning in applications with extreme balling tendencies. The bit designer may determine how much energy to project onto a given cone shell based on a variety of factors including, without limitation, the abrasiveness of the application, the amount of hydraulic energy that will be expended thru the bit hydraulic system and the number of hours the bit will be run.

Referring still to FIGS. 9 and 10, center sleeve 15*a* and associated center nozzle are preferably positioned and oriented to direct drilling fluid across the radially inner rows of cutting elements (e.g., cutting elements 84) in inner region 102 each cone 1-3. To enable cleaning of the radially inner rows of each cone 1-3, the center nozzle is preferably a multistage nozzle capable of forming three exiting streams of drilling fluid—one stream directed towards the inner rows of each cone 1-3. Since the velocity and energy of the streams of drilling fluid exiting a multistage nozzle are relatively low as previously described, a center multistage nozzle may be positioned in center sleeve 15a to direct drilling fluid over the top of each cone 1-3 with a reduced risk of cone erosion. In relatively small bits having insufficient space for both intermediate receptacles and a center receptacle (e.g., bits with a diameter less than 12.25), the intermediate receptacles and sleeves may be eliminated, and their cleaning duty taken over by a multistage center nozzle. In such embodiments, the center sleeve and associated multistage center nozzle are preferably positioned and oriented to direct drilling fluid across the cutting elements in the intermediate region of each cone cutter. Central receptacle 15 has central axis 15' as shown in FIG. 8.

The positioning and orientation of nozzle sleeves 15*a*, 25*a*, 35*a* and associated nozzles previously described offers the potential to increase the ROP and durability of bit 10 by enhancing cutting element cleaning and reducing cone shell impingement. Although preferred locations and orientations of the receptacles (e.g., receptacles 15, 25, 35), the sleeves (e.g., sleeves 15*a*, 25*a*, 35*a*), and the associated nozzles may have been described, the optimal positioning and orientation of each receptacle, sleeve, and nozzle may be varied depending on a variety of factors including, without limitation, the bit size, the formation being drilled, and the hydraulic energy provided to the bit from the surface. Thus, it should be appreciated that in other embodiments, the size, location, and orientation of each receptacle, sleeve, and nozzle may be different than that shown.

Embodiments described herein including three outer receptacles (e.g., outer receptacles 35), three intermediate receptacles (e.g., intermediate receptacles 25), and a center receptacle (e.g., center receptacle 15) are particularly suited for relatively larger bits with diameters greater than about 6.00 inches, and especially for those bits with diameters greater than about 20.00 inches. Relatively smaller bits inches may not provide sufficient space in the underside for both intermediate receptacles and a center receptacle. Consequently, in such smaller bits, the center receptacle or the intermediate receptacles may be eliminated. Moreover, in relatively smaller bits, fewer than six receptacles and nozzles may provide sufficient cleaning capability for the cutting elements and the borehole bottom. For instance, in smaller bits the surface area of the cutting structure to be cleaned is reduced. However, in relatively larger bits, the surface area of the cutting structure and borehole to be cleaned is increased, and may require additional receptacles and nozzles. Consequently, embodiments described herein including six or more receptacles are preferred for relatively larger bits having diameters greater than about 6.00 inches, and even more preferred for bits having diameters greater than about 20.00 inches.

Although the embodiment of bit 10 shown in FIG. 9 includes a sleeve 15*a*, 25*a*, 35*a* in each receptacle 15, 25, 35, in other embodiments, one or more receptacles may be bored and then tapped such that a nozzle is directly received by the receptacle, as opposed to a sleeve disposed within the receptacle. Since inclusion of a sleeve generally requires additional space, this option may be particularly suited to smaller bits where space is at a premium.

In some cases, it may be geometrically possible and practical to achieve the preferred drilling fluid trajectory by simply drilling or boring a straight receptacle in the dome region in alignment with the desired drilling fluid trajectory. With the sleeve coaxially disposed in the receptacle, the drilling fluid will flow through the sleeve and exit the nozzle disposed in the sleeve in a direction substantially aligned with the desired trajectory. For example, in this embodiment, receptacle 25 is a straight bore through underside 21 within which a straight cylindrical sleeve 25*a* is disposed. Receptacle 25 and sleeve 25*a* share a common central axis 25' that is aligned with the desired drilling fluid trajectory centerline 25*c*. Consequently, drilling fluid flowing through sleeve 25*a* and the nozzle disposed in the downstream end of sleeve 25*a* will exit along centerline 25*c*. However, in other cases, it may be geometrically impossible and/or impractical to bore the nozzle receptacle in alignment with the desired drilling fluid exiting trajectory. For example, in this embodiment, due to space limitations proximal the periphery of underside 21, outer sleeve receptacle 35 is bored through underside 21 along a centerline 35' that is out of alignment with the desired drilling fluid trajectory centerline 35*c*. Thus, the direction of drilling fluid flowing from plenum 24 through outer sleeve receptacle 35 must be adjusted to achieve the desired centerline 35*c*. As will be described in more detail below, in embodiments described herein, such adjustment in the direction of the drilling fluid is achieved by the sleeve (e.g., sleeve 35*a*).

Figure 11:
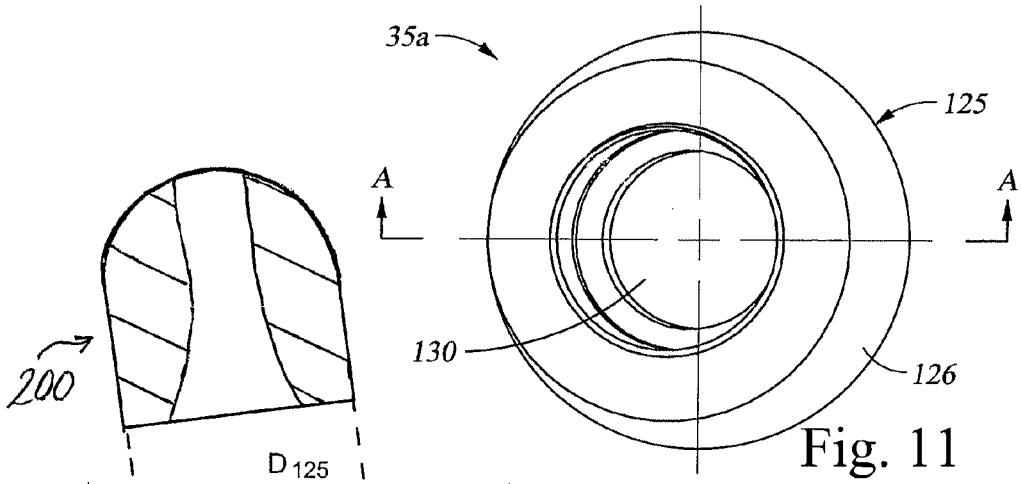
FIG. 11 is an end view of one of the outer sleeves of FIG. 1.
Figure 12B:
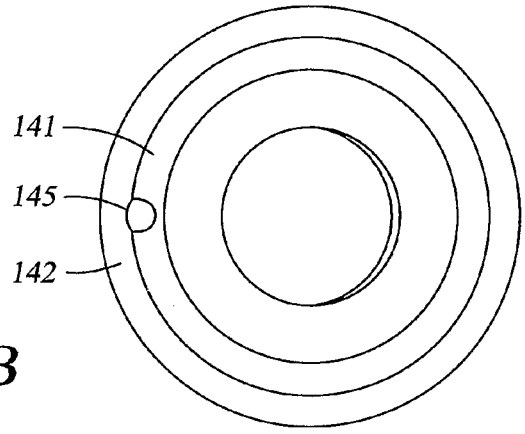
FIG. 12*b* is a partial end view of the outer nozzle retention sleeve of FIG. 11.
Figure 13:
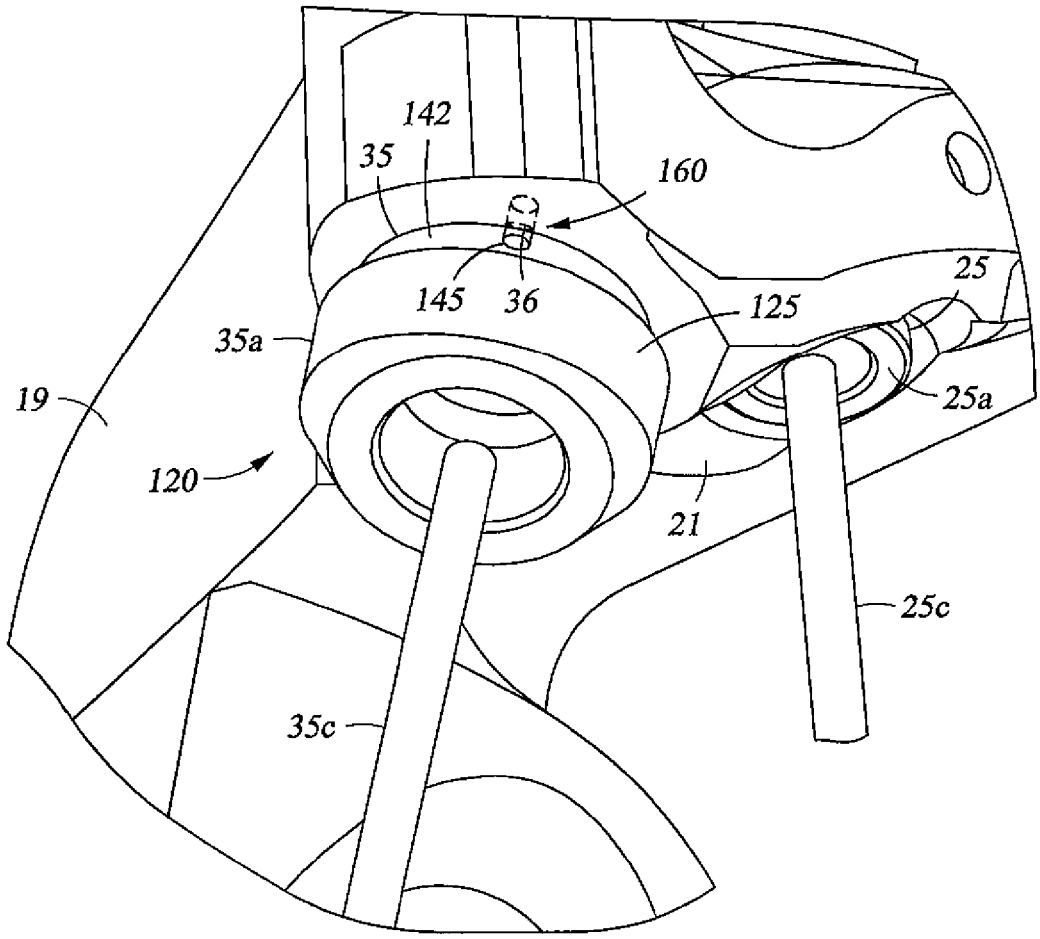
FIG. 13 is a side view of one of the legs of FIG. 1 illustrating the keyed engagement of the outer sleeve to the leg.

Referring now to FIGS. 11, 12*a*, and 12*b*, an embodiment of outer sleeve 35*a* is shown. Outer sleeve 35*a* includes an upstream end 110, a downstream end 120, and a through passage 130. Upstream end 110 has a cylindrical outer surface 111 defining a substantially uniform outer diameter D111. As best shown in FIGS. 8 and 13, when sleeve 35*a* is coupled to leg 19, upstream end 110 is disposed in receptacle 35 and downstream end 120 extends from underside 21. Consequently, the outer diameter D111 of upstream end 110 is preferably slightly less than the diameter of receptacle 35. Thus, upstream end 110 is sized and shaped to mate with receptacle 35.

Downstream end 120 comprises an enlarged generally cylindrical head 125 defining an outer diameter D125 that is greater than diameter D111. In this embodiment, head 125 includes a bevel 126 at its lowermost end that extends partially around the circumference of head 125. Bevel 126 provides additional clearance so that head 125 does not engage the borehole sidewall during drilling operations. At the intersection of upstream end 110 and downstream end 120, the outer surface of sleeve 35*a* comprises an annular frustoconical surface 141 and an annular concave surface 142. As best shown in FIGS. 12*a* and 12*b*, annular frustoconical surface 141 includes a counterbore or pin slot 145. As will be described in more detail below, pin slot 145 allows sleeve 35*a* to be keyed relative to receptacle 35 to achieve a specific orientation. In addition, as will be described in more detail below, in this embodiment, sleeve 35*a* is secured to bit body 12 with one or more weld beads disposed in annular concave surface 142.

Referring specifically to FIG. 12*a*, through passage 130 has a generally cylindrical first or upstream section 130*a* extending through upstream end 110, and a generally cylindrical second or downstream section 130*b* extending through downstream end 120. When sleeve 35*a* is coupled to bit body 12, upstream section 130*a* communicates with plenum 24 in bit body 12. In this embodiment, upstream end 130*a* includes a smoothly contoured curved entrance 132. Although entrance 132 is shown as having an elliptical cross-section, in general, entrance 132 may have any suitable cross-section. The smoothly curved entrance 132 offers the potential to increase the flow of fluid through sleeve 35*a*, reduce turbulence of the drilling fluid flowing through sleeve 35*a*, and reduce the erosive effects associated with high drilling fluid velocities and turbulent flow through sleeve 35*a*. Examples of nozzle retention sleeves including smoothly contoured elliptical entrances are described in U.S. Pat. No. 5,538,093, which is hereby incorporated herein by reference in its entirety.

Downstream section 130*b* is adapted to receive a fluid jet or nozzle 200. In general, the nozzle 200 may be coupled to downstream section 130*b* by any suitable means including, without limitation, mating threads, a snap ring, etc. In this embodiment, downstream section 130*b* includes an internally threaded increased diameter portion 134 and an annular seal gland 137. An O-ring seal (not shown) is disposed in gland 137, and the nozzle 200 is threadingly received by increased diameter portion 134. Once the nozzle is installed in downstream end 110, the O-ring forms a seal between the nozzle and sleeve 35*a*. Preferably, the nozzle reduces the cross-section of the flow passage through downstream section 130*b*, thereby accelerating the drilling fluid flowing immediately prior to exiting sleeve 35*a*.

Upstream section 130*a* has a central axis 131, and downstream section 130*b* has a central axis 133 oriented at an angle $\alpha$ relative to central axis 131. Thus, downstream section 130*b* may be described as being "skewed" relative to upstream section 130*a*. In this embodiment, when upstream section 130 is disposed in receptacle 35, axis 35' of receptacle 35 is coincident with axis 131.

During drilling operations, drilling fluid from plenum 24 flows into upstream section 130*a* of nozzle retention sleeve 35a through entrance 132, and flows through upstream section 130*a* generally parallel to axis 131. However, since downstream section 130*b* is skewed relative to upstream section 130*a*, the drilling fluid entering downstream section 130*b* is diverted. In particular, the flow of the drilling fluid is adjusted such that it is parallel to central axis 133. The drilling fluid exits downstream section 130a through the nozzle 200 generally in the direction of axis 133. Although axis 131 of upstream section 130*a* and axis 35' of receptacle 35 are skewed relative to centerline 35*c*, the desired drilling fluid trajectory centerline 35*c* previously described may be achieved by aligning axis 133 with centerline 35*c*. In this manner, sleeve 35*a*, and in particular, downstream section 130*b*, may be utilized to direct drilling fluid in a direction different from central axis 35' of nozzle receptacle 35 and central axis 131 of upstream section 130*a*.

It should be appreciated that angle $\alpha$ may be varied as desired to achieve the desired drilling fluid exit trajectory. However, for most applications, angle $\alpha$ is preferably between 2° and 30°, and more preferably between 5° and 12°. It should be appreciated that enlarged head 125 provides a greater wall thickness and material such that angle $\alpha$ may be varied by a greater degree without any portion of downstream section 130*b* exiting through the side of sleeve 35*a*. In general, the greater the diameter D125 the greater the angle $\alpha$ that may be accommodated for a given inner diameter of downstream section 130*b*. For most applications, the ratio of the head diameter D125 to upstream end outer diameter D110 is preferably between 1.0 and 2.0, and more preferably between 1.2 and 1.6.

Referring now to FIG. 13, nozzle retention sleeve 35*a* is coupled to leg 19 by aligning axes 35', 131 and axially inserting upstream end 130*a* of sleeve 35*a* into receptacle 35. Since the rotation of sleeve about axes 35', 131 will result in a different orientation of axis 133 relative to cones 1-3, sleeve 35*a* is preferably in keyed engagement with receptacle 35 such that axis 133 is aligned with the desired drilling fluid exit trajectory centerline 35*c*. As used herein, the phrase "keyed engagement" may be used to describe a single orientation engagement. In general, the keyed engagement may be accomplished by any suitable means including, without limitation, mating slot and rail, mating non-circular interfacing surfaces between the nozzle receptacle and the nozzle retention sleeve, aligned recesses and mating pin, or combinations thereof. In this embodiment, counterbore or slot 145 is provided on the outside surface of nozzle retention sleeve 35*a* as previously described. In addition, a corresponding counterbore or slot 36 is provided on the inner surface of nozzle receptacle 35. Slots 145, 36 are both substantially parallel with axes 35', 131.

During assembly, slot 145 is aligned with slot 36, pin 160 is disposed at least partially in one or both of slots 145, 36, and sleeve 35*a* is urged into receptacle 35, thereby urging pin 160 sufficiently into both slots 145, 36. Slot 36 is preferably positioned in bit body 12 about receptacle 35 such that alignment of slot 145 with slot 36 results in the alignment of axis 133 and centerline 35*c*. With upstream end 110 sufficiently inserted into receptacle 35 and sleeve 35*a* rotationally fixed relative to nozzle retention sleeve with slots 145, 36 and pin 160, sleeve 35*a* is welded to bit body 12 with a weld bead applied circumferentially around annular concave portion 142. Once nozzle retention sleeve 35*a* is sufficiently coupled to nozzle receptacle 35, a nozzle or jet may be coupled to downstream end 120. Since the keyed engagement aligns axis 133 and centerline 35*c*, the exiting drilling fluid will have a trajectory along centerline 35*c*.

Although a single keyed engagement mechanism is shown in FIG. 13, in other embodiments, two or more keyed engagement mechanisms may be provided. Further, in some embodiments, multiple keyed engagement mechanism may allow for a specific number of predetermined orientations of the nozzle retention sleeve (e.g., nozzle retention sleeve 35*a*) relative to the nozzle receptacle (e.g., nozzle receptacle 35) such that a given nozzle retention sleeve may be rotated to more than one predetermined orientation depending on the particular application.

Referring still to FIG. 13, nozzle retention sleeve 35*a*, and in particular head 125, extends from the lower surface of underside 21. Consequently, nozzle retention sleeve 35*a* may also be described as "extended" or as an "extended nozzle retention sleeve." In this embodiment, intermediate sleeve 25*a* and center sleeve 15*a* also extend from the lower surface of underside 21, and thus, may also be described as extended. In some embodiments, one or more sleeves (e.g., sleeves 25*a*, 35*a*) may extend below the highest horizontal plane perpendicular to the bit axis (e.g., bit axis 11) that intersects the uppermost surfaces of the cones (e.g., cones 1-3). Generally, this highest plane is the plane intersected by the gage rows of inserts when positioned in a top most position of the cones within the dome region of the bit. For relatively larger bits having diameters greater than 6.00 inches, head 125 preferably extends at least one inch from underside 21.

In general, extended sleeves offer the potential to enhance the energy with which the discharged drilling fluid impacts the cutter elements and borehole bottom. Without being limited by this or any particular theory, the velocity profile of fluid exiting a nozzle generally decreases as the distance from the end of the nozzle increases as the fluid flow column diverges or increases in diameter with distance from the nozzle exit. Thus, by extending sleeve 35*a*, the nozzle disposed therein may be positioned closer to the cutter elements and borehole bottom, thereby offering the potential for a relatively higher drilling fluid velocity and energy upon impact with the cutter elements and borehole bottom.

In relatively larger bits, drilling fluid energy distribution and hydraulic optimization may be particularly challenging because the nozzles tend to be positioned at a greater height relative to the cutting structure and borehole bottom, and the surface area to be flushed and cleaned by the nozzles is relatively large. Consequently, extended sleeves (e.g., sleeves 35*a*) may be particularly preferred for bits having diameters greater than about 6.00 inches, and more preferred for bits having diameters greater than about 20.00 inches.

As previously described, receptacles 25, 35 may be formed in each leg 19 by drilling or boring operations. Such techniques provide several advantages over milling operations used in the manufacture of some conventional bits. For example, drilling operations tend to be less complex, less time consuming, and hence, less expensive than milling operations. Further, as compared to drilling operations, milling operations often result in increased tolerance variability due to vibrations and chatter common in milling operations. Such tolerance variability in the coupling between the nozzle and the bit body may result in a drilling fluid trajectory that is slightly skewed from the desired drilling fluid trajectory. For example, U.S. Pat. No. 6,571,887 discloses a nozzle retention body mounted to the side of a rolling cone bit by a single orientation mounting. In particular, a reception slot is machined into the leg. The reception slot includes four orthogonal surfaces that mate with the upper end of the retention body. The retention body is positioned in the reception slot in the particular orientation and welded in place. The reception slot is conventionally formed by milling the side of the bit leg. Due to vibration and chatter during milling, tolerance variations may arise in the fit of the retention body and the reception slot. As a result, the retention body, and hence the trajectory of the drilling fluid therefrom, may be slightly askew from the desired orientation. In some cases, an askew drilling fluid trajectory may inadvertently target the cone shell, potentially leading to premature cone erosion. However, embodiments described herein offer the potential to reduce tolerance variation by utilizing receptacles that may be formed by drilling in the bit body (e.g., receptacles 25, 35), and weld-in nozzle retention sleeves (e.g., sleeves 25*a*, 35*a*).

Moreover, by employing cylindrical receptacles (e.g., receptacles 25, 35) that receive the mating cylindrical upper ends of the sleeves (e.g., sleeves 25*a*, 35*a*), embodiments described herein offer the potential for increased flexibility. For example, in the case of a sleeve having an outlet skewed relative to its inlet (e.g., sleeve 35*a*), the sleeve may be rotated about the receptacle central axis to modify the orientation of the drilling fluid trajectory for a particular bit or a specific application. As another example, the orientation of the keyed engagement of the sleeve and the receptacle may be modified by simply changing the location of the slot about the circumference of the sleeve, as opposed to modifying the bit body, which may be time consuming and expensive.

In an embodiment, a drill bit for drilling through an earthen formation to form a borehole with a bottom and a sidewall, the drill bit having a full gage diameter with a radius R, comprises a bit body having a central axis, an internal plenum, and an underside generally facing the borehole bottom. The underside includes a central region disposed about the central axis, an annular outer region, and an annular intermediate region radially disposed between the central region and the outer region. The bit body includes an outer receptacle having a central axis and extending from the plenum to the outer region of the underside. In addition, the drill bit comprises a first and a second cone cutter, each of the cone cutters being mounted to the bit body and adapted for rotation about a different cone axis. Each cone cutter comprises an inner region proximal the bit axis, an outer region distal the bit axis, and an intermediate region extending between the inner region and the outer region. The inner region, the intermediate region, and the outer region each include a plurality of cutting elements. Further, the drill bit comprises an outer sleeve having an upstream end, a downstream end, and a through passage extending between the upstream end and the downstream end. The upstream end is coaxially received by the outer sleeve receptacle. The through passage includes an upstream section having an upstream axis and a downstream section having a downstream axis that is skewed at an angle $\alpha$ relative to the upstream axis. A projection of the downstream axis passes between the outer regions of the first and second cone cutters.

In other embodiments, the bit body includes an intermediate receptacle having a central axis and extending from the plenum to the intermediate region of the underside. In addition, the bit body further includes a central receptacle having a central axis and extending from the plenum to the central region of the underside. Further, the drill bit comprises a central nozzle disposed within the central receptacle. The central nozzle is a multistage nozzle oriented to direct drilling fluid between the intermediate regions of the first and second cone cutters. In other embodiments, the multistage nozzle is oriented to direct drilling fluid toward the surface of the first cone cutter.

In other embodiments, the bit body includes a central receptacle having a central axis and extending from the plenum to the central region of the underside. In addition, the drill bit comprises a central nozzle disposed within the central receptacle. The central nozzle is a multistage nozzle oriented to direct drilling fluid between the intermesh regions of the first cone cutter and the second cone cutter. In other embodiments, the central nozzle is oriented to direct drilling fluid toward the surface of at least one of the cone cutters.

In still other embodiments, the upstream end has an outer diameter and the downstream end comprises a head having an outer diameter that is greater than the outer diameter of the upstream end. The ratio of the outer diameter of the head to the outer diameter of the upstream end is between 1.0 and 2.0.

In another embodiment, a drill bit for drilling an earthen formation, the drill bit having a full gage diameter with a radius R, comprises a bit body having a central axis, an internal plenum, and a underside. In addition, the drill bit comprises a plurality of cone cutters, each of the cone cutters being mounted to the bit body and adapted for rotation about a different cone axis. Further, the drill bit comprises a first receptacle having a central axis and extending from the underside to the plenum of the bit body. Still further, the drill bit comprises a first sleeve having an upstream end, a downstream end, and a through passage extending between the upstream end and the downstream end. The upstream end is coaxially received by the sleeve receptacle. The through passage includes an upstream section having an upstream axis and downstream section having a downstream axis that is skewed relative to the upstream axis.

In other embodiments, the drill bit comprises a second sleeve having an upstream end disposed in the second receptacle and a downstream end comprising a multistage nozzle.

In yet another embodiment, a drill bit for drilling an earthen formation comprises a bit body having a central axis and a underside. In addition, the drill bit comprises a plurality of cone cutters, each of the cone cutters being mounted to the bit body and adapted for rotation about a different cone axis. The bit body comprises a plurality of outer receptacle in the underside proximal the outer periphery of the bit body and a plurality of intermediate receptacles in the underside radially positioned between the outer receptacles and the bit axis. Each receptacle has a central axis. Further, the drill bit comprises an outer sleeve at least partially disposed in one of the outer sleeve receptacles. The outer sleeve has a through passage including an upstream section with a upstream axis aligned with the central axis of the outer receptacle and a downstream section with a downstream axis skewed relative to the upstream axis.

In other embodiments, the bit body further comprises a central receptacle in the underside proximal the bit axis. The center nozzle comprises a multistage nozzle having a plurality of exit ports to direct fluid flow to a plurality of locations. In addition, the bit body comprises a plurality of legs. At least one of the intermediate receptacles and at least one of the outer receptacles is positioned between each pair of adjacent cone cutters.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Although embodiments of the bits described herein (e.g., bit 10) are insert or TCI bits, embodiments of the hydraulic layouts, designs, and nozzle retention sleeves may also be employed with milled tooth bits. Accordingly, the scope of protection is not limited to the embodiments described herein, but is only limited by the claims that follow, the scope of which shall include all equivalents of the subject matter of the claims.

What is claimed is:

1. A drill bit for drilling through an earthen formation to form a borehole with a bottom and a sidewall, the drill bit having a full gage diameter with a radius R and comprising:

a bit body having a central axis, an internal plenum, and an underside generally facing the borehole bottom, wherein the underside includes a central region disposed about the central axis, an annular outer region, and an annular intermediate region radially disposed between the central region and the annular outer region;

wherein the bit body includes an outer receptacle having a central axis and extending from the plenum to the annular outer region of the underside;

a first and a second cone cutter, each of the cone cutters being mounted to the bit body and adapted for rotation about a different cone axis;

wherein each cone cutter comprises an inner region proximal the central axis of the bit body, an outer region distal the central axis of the bit body, and an intermediate region extending between the inner region and the outer region;

wherein the inner region, the intermediate region, and the outer region each include a plurality of cutting elements;

an outer sleeve having an upstream end, a downstream end, and a through passage extending between the upstream end and the downstream end, wherein the upstream end is coaxially received by the outer receptacle;

an outer nozzle received by the downstream end of the outer sleeve, wherein the through passage includes an upstream section having an upstream axis and a downstream section having a downstream axis that is skewed at an angle $\alpha$ relative to the upstream axis, and wherein the downstream axis and the upstream axis intersect in a portion of the sleeve that is one uniform piece; and wherein a projection of the downstream axis passes between the outer regions of the first and second cone cutters.

2. The drill bit of claim 1 wherein the cutting elements of the inner region of each cone cutter are positioned to contact the hole bottom between the central axis of the bit body and about 25% of the radius R, the cutting elements of the intermediate region of each cone cutter are positioned to contact the hole bottom between the inner region and about 75% of the radius R, and the cutting elements of the outer region of each cone cutter are positioned to contact the hole bottom between the intermediate region and the radius R.

3. The drill bit of claim 2 wherein the angle $\alpha$ is between 2° and 30°.

4. The drill bit of claim 3 wherein the angle $\alpha$ is between 5° and 12°.

5. The drill bit of claim 3 wherein the full gage diameter is at least six inches.

6. The drill bit of claim 5 wherein the full gage diameter is at least twenty inches.

7. The drill bit of claim 3 wherein each cone cutter has a leading side and a trailing side, and wherein a projection of the downstream axis is tilted toward the leading side of the first cone cutter.

8. The drill bit of claim 3 wherein each cone cutter has a leading side and a trailing side, and wherein a projection of the downstream axis is tilted toward the trailing side of the first cone cutter.

9. The drill bit of claim 3 wherein the upstream end has an outer diameter and the downstream end comprises a head having an outer diameter that is greater than the outer diameter of the upstream end.

10. The drill bit of claim 9 wherein the ratio of the outer diameter of the head to the outer diameter of the upstream end is between 1.2 and 1.6.

11. The drill bit of claim 1 wherein the central region extends from the central axis of the bit body to about 10% of the radius R, the annular intermediate region extends from the central region to about 50% of the radius R, and the annular outer region extends from the intermediate region to about 90% of the radius R.

12. The drill bit of claim 1 further comprising a keyed engagement between the outer sleeve and the outer receptacle for restricting the rotational orientation of the outer sleeve relative to the outer receptacle.

13. The drill bit of claim 12, wherein the keyed engagement comprises a pin having a first end disposed within a mating slot provided in an inner surface of the outer receptacle and a second end disposed within a mating slot provided in an outer surface of the outer sleeve.

14. The drill bit of claim 1 wherein the plurality of cutting elements of the inner region are non-intermeshing cutting elements;

wherein the plurality of cutting elements of the outer region are non-intermeshing cutting elements; and wherein the plurality of cutting elements of the intermediate region are intermeshing cutting elements.

15. The drill bit of claim 1 wherein the bit body includes an intermediate receptacle having a central axis and extending from the plenum to the annular intermediate region of the underside.

16. The drill bit of claim 15 further comprising an intermediate sleeve having a central axis, wherein the intermediate sleeve is at least partially disposed in the intermediate receptacle and a projection of the central axis of the intermediate sleeve passes between the intermediate regions of the first and second cone cutters.

17. The drill bit of claim 15 further comprising an intermediate sleeve having a central axis, wherein the intermediate sleeve is at least partially disposed in the intermediate receptacle and a projection of the central axis of the intermediate sleeve intersects a surface of the first cone cutter in the intermediate region.

18. The drill bit of claim 17, wherein the intermediate receptacle is radially positioned between about 25% and about 30% of the radius R, and wherein approximately 20% to 55% of the total volumetric flow of drilling fluid through the plenum passes through the intermediate sleeves.

19. The drill bit of claim 15 wherein the bit body further includes a central receptacle having a central axis and extending from the plenum to the central region of the underside.

20. The drill bit of claim 19 further comprising a central nozzle disposed within the central receptacle.

21. The drill bit of claim 1 wherein the bit body includes a central receptacle having a central axis and extending from the plenum to the central region of the underside.

22. A drill bit for drilling an earthen formation, the drill bit having a full gage diameter with a radius R and comprising:

a bit body having a bit axis, an internal plenum, and an underside;

a plurality of cone cutters, each of the cone cutters being mounted to the bit body and adapted for rotation about a different cone axis;

a first receptacle having a central axis and extending from the underside to the plenum of the bit body;

a first sleeve having an upstream end having an entrance, a downstream end having an exit, and a through passage extending between the entrance of the upstream end and the exit of the downstream end, wherein the upstream end is coaxially received by the first receptacle; and a first nozzle received through the exit of the downstream end of the first sleeve, wherein the through passage includes an upstream section having an upstream axis and a downstream section having a downstream axis that is skewed relative to the upstream axis.

23. The bit of claim 22 wherein the first receptacle is cylindrical and the upstream end of the first sleeve is cylindrical, and wherein the downstream axis is oriented at an acute angle $\alpha$ relative to the upstream axis, and wherein the angle $\alpha$ is between 2° and 30°.

24. The drill bit of claim 23 wherein the angle $\alpha$ is between 5° and 12°.

25. The bit of claim 23 further comprising a keyed engagement means between the first sleeve and the first receptacle for restricting the rotational orientation of the first sleeve relative to the first receptacle.

26. The drill bit of claim 25 wherein the keyed engagement means comprises a pin having a first end disposed within a mating slot provided in an inner surface of the first receptacle and a second end disposed within a mating slot provided in an outer surface of the first sleeve.

27. The drill bit of claim 23 wherein the underside has an annular outer region extending from about 50% of the radius R to about 90% of the radius R, and wherein the first receptacle is positioned in the outer region.

28. The drill bit of claim 23 wherein the upstream end has an outer diameter and the downstream end comprises a head having an outer diameter that is greater than the outer diameter of the upstream end.

29. The drill bit of claim 22 further comprising a second receptacle having a central axis and extending from the underside to the plenum of the bit body, wherein the second receptacle is positioned radially inward of the first receptacle.

30. The drill bit of claim 29 wherein the underside has a central region extending from the bit axis to about 10% of the radius R, an annular intermediate region extending from the central region to about 50% of the radius R, and an annular outer region extending from the annular intermediate region to about 90% of the radius R, and wherein the first receptacle is disposed in the annular outer region and the second receptacle is disposed in the annular intermediate region.

31. The drill bit of claim 30 wherein the first receptacle and the second receptacle are circumferentially disposed between a first and a second of the plurality of cone cutters.

32. The drill bit of claim 31 wherein each cone cutter includes a gage row of gage cutting elements, a first inner row of bottomhole cutting elements adjacent the gage row, and a second inner row of bottomhole cutting elements; wherein a projection of the downstream axis of the through passage of the first sleeve passes between the first and second cone cutters and intersects at least one of the gage cutting elements and at least one of the bottomhole cutting elements in the first inner row.

33. The drill bit of claim 32 further comprising a second sleeve having a central axis, wherein the second sleeve is at least partially disposed in the second receptacle and a projection of the central axis of the second sleeve passes between the first and second cone cutters and intersects at least one of the bottomhole cutting elements in the second inner row.

34. The drill bit of claim 33, further comprising a second nozzle received by the second sleeve.

35. The drill bit of claim 29 wherein the underside has a central region extending from the bit axis to about 10% of the radius R, an annular intermediate region extending from the central region to about 50% of the radius R, and an annular outer region extending from the annular intermediate region to about 90% of the radius R, and wherein the first receptacle is disposed in the annular outer region and the second receptacle is disposed in the central region.

36. The drill bit of claim 22 wherein the downstream end of the first sleeve extends from the bit body.

37. The drill bit of claim 36 wherein the downstream end extends at least one inch from the bit body.

38. The drill bit of claim 22, wherein the first receptacle comprises a straight bore with a single central axis, and wherein the upstream end of the first sleeve mates with the straight bore of the first receptacle.

39. The drill bit of claim 22, wherein the sleeve is welded to the receptacle.

40. A drill bit for drilling an earthen formation comprising:

a bit body having a bit axis and an underside and an outer periphery;

a plurality of cone cutters, each of the cone cutters being mounted to the bit body and adapted for rotation about a different cone axis;

wherein the bit body comprises an outer receptacle in the underside proximal the outer periphery of the bit body , and wherein the outer receptacle has a central axis;

an outer sleeve at least partially disposed in the outer receptacle;

wherein the outer sleeve has a through passage including an upstream section with an upstream axis aligned with the central axis of the outer receptacle and a downstream section with a downstream axis skewed relative to the upstream axis; and an outer nozzle received by the downstream section of the outer sleeve, wherein the upstream axis and the downstream axis intersect upstream of the outer nozzle.

41. The drill bit of claim 40 wherein the downstream axis is oriented at an acute angle $\alpha$ relative to the upstream axis, and wherein the angle $\alpha$ is between 2 and 30°.

42. The drill bit of claim 41 wherein the angle $\alpha$ is between 5° and 12°.

43. The drill bit of claim 40 further comprising a keyed engagement means between the outer sleeve and the outer receptacle for restricting the rotational orientation of the outer sleeve relative to the outer receptacle.

44. The drill bit of claim 43 wherein the keyed engagement means comprises a pin having a first end disposed within a mating slot provided in an inner surface of the outer receptacle and a second end disposed within a mating slot provided in an outer surface of the outer sleeve.

45. The drill bit of claim 40 wherein the outer sleeve has an upstream end disposed within the outer receptacle and a downstream end extending from the bit body.

46. The drill bit of claim 45 wherein the downstream end extends at least one inch from the bit body.

47. The drill bit of claim 45 wherein the upstream end has an outer diameter and the downstream end comprises a head having an outer diameter that is greater than the outer diameter of the upstream end.

48. The drill bit of claim 47 wherein the ratio of the outer diameter of the head to the outer diameter of the upstream end is between 1.2 and 1.6.

49. The drill bit of claim 40 wherein the drill bit defines a full gage diameter having a radius R and the underside has an annular intermediate region extending from about 10% of the radius R to about 50% of the radius R and an annular outer region extending from about 50% of the radius R to about 90% of the radius R, and wherein the outer receptacle is positioned in the annular outer region and further comprising an intermediate receptacle that is positioned in the annular intermediate region.

50. The drill bit of claim 40 wherein the bit body further comprises a central receptacle in the underside proximal the bit axis.

51. The drill bit of claim 40 further comprising an intermediate receptacle in the underside radially positioned between the outer receptacle and the bit axis, and an intermediate sleeve disposed within the intermediate receptacle.

52. The drill bit of claim 51 wherein the outer sleeve and the intermediate sleeve extend from the bit body.

53. The drill bit of claim 51, further comprising an intermediate nozzle received by the intermediate sleeve.

54. The drill bit of claim 40 further comprising an intermediate receptacle in the underside radially positioned between the outer receptacle and the bit axis, and wherein the outer receptacle and the intermediate receptacle are circumferentially spaced between the cone axis of a first of the plurality of cone cutters and the cone axis of a second of the plurality of cone cutters.

55. The drill bit of claim 40, further comprising a plurality of outer receptacles and a plurality of intermediate receptacles.

56. The drill bit of claim 40, wherein the sleeve is welded to the receptacle.

57. The drill bit of claim 40 wherein each cone cutter includes a gage row of gage cutting elements , a first inner row of bottomhole cutting elements adjacent the gage row, and a second inner row of bottomhole cutting elements adjacent the first inner row;

wherein at least some of the bottomhole cutting elements on a pair of adjacent cone cutters of the plurality of cone cutters comprise intermeshing inner row cutting elements; and wherein a projection of the downstream axis of the through passage of the outer sleeve is directed towards the first inner row of bottomhole cutting elements of at least one cone cutter.

58. The drill bit of claim 57 further comprising an intermediate receptacle in the underside radially positioned between the outer receptacle and the bit axis, and an intermediate sleeve having a central axis and coaxially disposed within the intermediate receptacle, wherein a projection of the central axis of the intermediate sleeve is directed towards the intermeshing inner row cutting elements between one pair of adjacent cone cutters.

59. A method of assembling a drill bit, comprising:

providing a bit body having an internal plenum and an underside;

providing a receptacle in the underside of the bit body, the receptacle in fluid communication with the internal plenum, inserting a sleeve at least partially into the receptacle, the sleeve having an upstream section with an upstream axis and a downstream section with a downstream axis skewed relative to the upstream axis, the downstream section having an exit, rotating the sleeve within the receptacle to align the downstream axis with a desired fluid trajectory;

fixing the rotational orientation of the sleeve with respect to the receptacle; and coupling a nozzle to the downstream section of the sleeve, wherein coupling the nozzle comprises inserting the nozzle through the exit of the sleeve.

60. The method of claim 59, wherein the receptacle comprises an outer receptacle in an annular outer region of the bit body.

61. The method of claim 60, wherein providing the outer receptacle comprises drilling or boring the outer receptacle into the bit body.

62. The method of claim 60, wherein rotating the sleeve comprises rotating the sleeve to a position in which the downstream axis points toward an outer region of a cone cutter mounted to the bit body.

63. The method of claim 62, wherein rotating the sleeve comprises rotating the sleeve to a position in which the downstream axis points toward a leading side of a cone cutter mounted to the bit body.

64. The method of claim 59, wherein fixing the rotational orientation of the sleeve comprises engaging the sleeve to the receptacle by a keyed engagement means.

65. The method of claim 64, wherein fixing the rotational orientation of the sleeve further comprises welding the sleeve to the receptacle.

66. The method of claim 59, wherein the receptacle comprises a straight bore with a single central axis, and wherein the upstream section of the sleeve mates with the straight bore.

67. The method of claim 59, wherein fixing the rotational orientation comprises welding.

* * * * *